US009422082B2

(12) United States Patent
Nolan et al.

(10) Patent No.: US 9,422,082 B2
(45) Date of Patent: Aug. 23, 2016

(54) CONTAINER ASSEMBLY AND LATCH APPARATUS, AND RELATED METHODS

(76) Inventors: Roger Nolan, Seymour, IN (US); Todd Turner, Paris, KY (US)

( * ) Notice: Subject to any disclaimer, the term of this patent is extended or adjusted under 35 U.S.C. 154(b) by 1147 days.

(21) Appl. No.: 11/916,407

(22) PCT Filed: Jun. 3, 2005

(86) PCT No.: PCT/US2005/019352
§ 371 (c)(1),
(2), (4) Date: Nov. 19, 2008

(87) PCT Pub. No.: WO2006/132613
PCT Pub. Date: Dec. 14, 2006

(65) Prior Publication Data

US 2009/0205169 A1 Aug. 20, 2009

(51) Int. Cl.
*E05C 1/08* (2006.01)
*E05C 1/10* (2006.01)
(Continued)

(52) U.S. Cl.
CPC ..... *B65D 19/18* (2013.01); *B65D 11/18* (2013.01); *E05C 1/10* (2013.01);
(Continued)

(58) Field of Classification Search
CPC ..... E05C 19/06; E05C 1/08; E05C 19/022; E05C 9/046; E05C 1/163; E05C 1/00; E05C 1/002; E05C 1/004; E05C 1/006; E05C 1/02; E05C 17/48; E05C 19/028; E05C 2001/008; E05C 9/02; E05C 9/028; E05C 9/20; E05C 9/22; Y10T 292/0969; Y10T 292/096; Y10T 292/0834; E05B 85/22; E05B 15/04; E05B 15/101; E05B 17/0037; E05B 63/20
USPC ..... 292/137, 156, 163, 175, 138, 145, 146, 292/DIG. 31, 1, 3, DIG. 11, DIG. 12, 292/DIG. 35, DIG. 47, 157, DIG. 63, 292/DIG. 61, DIG. 20
See application file for complete search history.

(56) References Cited

U.S. PATENT DOCUMENTS 294,329 A * 2/1884 Otis ..... 292/175
667,297 A * 2/1901 Crawford ..... 70/150
(Continued)

FOREIGN PATENT DOCUMENTS

DE 135488 11/1933
EP 0 211 116 A2 2/1987
(Continued)

OTHER PUBLICATIONS

International Search Report for PCT/US2005/019352, mailed May 2, 2006.
(Continued)

*Primary Examiner* — Kristina Fulton
*Assistant Examiner* — Faria Ahmad
(74) *Attorney, Agent, or Firm* — Nixon Peabody LLP

(57) ABSTRACT

Apparatus and methods for engaging and disengaging various members to each other are described herein. The preferred apparatus and methods reduce the number of components and/or sub-assemblies in hinged apparatus and methods and other applications, and simplify and improve the quality and efficiency of installation and removal of latches associated with the hinged elements or members. The latching/locking system and methods of the invention also enable selective relatively permanent engagement of the hinged elements or members to each other, and can permit selective transition between the foregoing hinged and locked relationships. Improved latches are disclosed, with interchangeability, keying to assist assembly, and other features. Methods of fabrication and assembly are disclosed.

43 Claims, 24 Drawing Sheets

(51) Int. Cl.

| | |
|---|---|
| ***B65D 19/18*** | (2006.01) |
| ***B65D 6/16*** | (2006.01) |
| *E05C 1/02* | (2006.01) |
| *E05C 1/04* | (2006.01) |
| *E05C 1/06* | (2006.01) |

(52) U.S. Cl.

CPC ..... *B65D 2519/00034* (2013.01); *B65D 2519/00069* (2013.01); *B65D 2519/00174* (2013.01); *B65D 2519/00243* (2013.01); *B65D 2519/00333* (2013.01); *B65D 2519/00417* (2013.01); *B65D 2519/00422* (2013.01); *B65D 2519/00611* (2013.01); *B65D 2519/00661* (2013.01); *Y10T 16/5402* (2015.01)

(56) References Cited

U.S. PATENT DOCUMENTS

| | | | | | |
|---|---|---|---|---|---|
| 910,709 | A | * | 1/1909 | Mulrooney | 292/8 |
| 1,058,952 | A | * | 4/1913 | Durner | 292/42 |
| 1,137,828 | A | * | 5/1915 | Anderson | 292/175 |
| 1,139,869 | A | * | 5/1915 | Howard | E05B 65/0864 292/175 |
| 1,280,629 | A | | 10/1918 | Appleby | |
| 1,486,998 | A | * | 3/1924 | Wiley | 292/169.11 |
| 1,654,221 | A | * | 12/1927 | Kline | E05B 63/06 292/159 |
| 1,855,996 | A | * | 4/1932 | Schrader | 292/341.11 |
| 2,476,520 | A | * | 7/1949 | Waitekaites | 70/150 |
| 3,628,683 | A | | 12/1971 | Friedrich | |
| 3,677,196 | A | * | 7/1972 | Schuller | 105/377.11 |
| 3,806,173 | A | * | 4/1974 | Sweda | 292/67 |
| 3,924,293 | A | | 12/1975 | Cain | |
| 3,955,842 | A | * | 5/1976 | Edwards | 292/307 R |
| 3,977,044 | A | | 8/1976 | Mort | |
| 4,039,213 | A | * | 8/1977 | Walters | 285/317 |
| 4,060,267 | A | * | 11/1977 | Monfardini | 292/173 |
| 4,063,330 | A | | 12/1977 | Triplette | |
| 4,089,417 | A | | 5/1978 | Osborne | |
| 4,349,121 | A | | 9/1982 | Lafferty | |
| 4,400,026 | A | * | 8/1983 | Brown, Jr. | 292/175 |
| 4,418,828 | A | * | 12/1983 | Wilde et al. | 215/252 |
| 4,466,541 | A | | 8/1984 | Tabler et al. | |
| 4,591,065 | A | | 5/1986 | Foy | |
| 4,600,278 | A | * | 7/1986 | Saito | G03B 11/06 220/326 |
| 4,674,647 | A | * | 6/1987 | Gyenge et al. | 220/6 |
| 4,709,825 | A | * | 12/1987 | Mumford | 215/318 |
| 4,775,068 | A | | 10/1988 | Reiland et al. | |
| 4,828,132 | A | | 5/1989 | Francis, Jr. et al. | |
| 4,917,255 | A | | 4/1990 | Foy et al. | |
| 4,917,416 | A | * | 4/1990 | Westphal et al. | 292/175 |
| 4,923,079 | A | * | 5/1990 | Foy | 220/7 |
| 4,967,927 | A | | 11/1990 | Reiland et al. | |
| 5,042,854 | A | * | 8/1991 | Huang | E05C 1/10 292/163 |
| 5,094,356 | A | * | 3/1992 | Miller | 220/7 |
| 5,100,009 | A | * | 3/1992 | Thompson et al. | 215/341 |
| 5,199,589 | A | * | 4/1993 | Noble | 220/7 |
| 5,199,592 | A | | 4/1993 | Reiland et al. | |
| 5,398,835 | A | | 3/1995 | Blinstrub | |
| 5,474,197 | A | | 12/1995 | Hillis et al. | |
| 5,586,675 | A | | 12/1996 | Borsboom et al. | |
| D381,513 | S | | 7/1997 | Brauner | |
| 5,769,230 | A | | 6/1998 | Koefelda | |
| 5,845,799 | A | | 12/1998 | Deaton | |
| 5,938,059 | A | | 8/1999 | Luburic | |
| 5,975,592 | A | * | 11/1999 | Lin | 292/37 |
| 6,000,604 | A | | 12/1999 | Lapoint, III | |
| 6,015,056 | A | | 1/2000 | Overholt et al. | |
| 6,029,840 | A | | 2/2000 | Brauner | |
| 6,053,992 | A | * | 4/2000 | Wu et al. | 148/402 |
| 6,088,239 | A | | 7/2000 | Zeiss | |
| 6,098,827 | A | | 8/2000 | Overholt et al. | |
| 6,102,452 | A | * | 8/2000 | Liau | 292/175 |
| 6,135,287 | A | | 10/2000 | Hartwall | |
| 6,209,742 | B1 | | 4/2001 | Overholt et al. | |
| 6,283,319 | B1 | | 9/2001 | Hillis et al. | |
| 6,293,417 | B1 | | 9/2001 | Varfeldt | |
| 6,293,418 | B1 | | 9/2001 | Ogden et al. | |
| 6,299,223 | B1 | * | 10/2001 | Ji et al. | 292/175 |
| 6,305,566 | B1 | | 10/2001 | Pigott et al. | |
| 6,305,726 | B1 | * | 10/2001 | LeTrudet | 292/175 |
| D452,614 | S | | 1/2002 | Overholt | |
| 6,386,388 | B1 | | 5/2002 | Overholt | |
| 6,398,054 | B1 | | 6/2002 | Overholt et al. | |
| 6,405,888 | B1 | | 6/2002 | Overholt et al. | |
| 6,409,041 | B1 | | 6/2002 | Overholt et al. | |
| 6,446,825 | B1 | | 9/2002 | Godoy | |
| 6,457,789 | B2 | * | 10/2002 | Hallsten | 312/333 |
| 6,460,717 | B1 | | 10/2002 | Smyers et al. | |
| 6,484,898 | B2 | * | 11/2002 | Hillis et al. | 220/6 |
| RE37,915 | E | | 12/2002 | Lapoint, III | |
| 6,601,724 | B1 | | 8/2003 | Koefelda et al. | |
| 6,612,625 | B1 | * | 9/2003 | Barber et al. | 292/87 |
| 6,631,822 | B1 | | 10/2003 | Overholt | |
| 6,631,931 | B2 | * | 10/2003 | Magnusson | B63B 19/00 292/164 |
| 6,669,044 | B2 | | 12/2003 | Murakami et al. | |
| 6,669,242 | B2 | * | 12/2003 | Fountaine et al. | 292/11 |
| 6,733,049 | B2 | * | 5/2004 | Piorkowski et al. | B64C 1/1469 292/139 |
| 6,772,897 | B2 | | 8/2004 | Kellerer et al. | |
| 6,783,032 | B2 | | 8/2004 | Fons | |
| 6,783,058 | B2 | | 8/2004 | Quaintance | |
| 6,786,394 | B2 | | 9/2004 | Prince | |
| 6,838,616 | B2 | | 1/2005 | Harrison et al. | |
| 6,863,180 | B2 | | 3/2005 | Apps et al. | |
| 6,899,242 | B2 | | 5/2005 | Overholt et al. | |
| 6,918,502 | B1 | | 7/2005 | Overholt et al. | |
| 7,017,765 | B2 | | 3/2006 | Overholt | |
| 7,017,766 | B2 | | 3/2006 | Hsu et al. | |
| 7,044,319 | B2 | | 5/2006 | Overholt et al. | |
| 7,059,489 | B2 | | 6/2006 | Apps et al. | |
| 7,086,555 | B2 | | 8/2006 | Overholt et al. | |
| 7,097,214 | B2 | * | 8/2006 | Tsai | 292/157 |
| 7,100,786 | B2 | | 9/2006 | Smyers | |
| 7,104,414 | B2 | | 9/2006 | Apps et al. | |
| 7,128,231 | B2 | | 10/2006 | Overholt | |
| 7,172,222 | B1 | * | 2/2007 | Hotovy | E05C 1/04 292/137 |
| 7,195,127 | B2 | | 3/2007 | Hsu et al. | |
| 7,520,541 | B1 | * | 4/2009 | Lawrence | 292/175 |
| 7,731,251 | B2 | * | 6/2010 | Ye | 292/163 |
| 7,874,598 | B2 | * | 1/2011 | Chung | 292/163 |
| 8,424,931 | B2 | * | 4/2013 | Chang | 292/137 |
| 8,602,463 | B2 | * | 12/2013 | Keighley et al. | 292/143 |
| 8,801,051 | B2 | * | 8/2014 | Hobbs et al. | 292/163 |
| 2003/0157836 | A1 | * | 8/2003 | Morikawa et al. | 439/607 |
| 2004/0065699 | A1 | | 4/2004 | Schoer et al. | |
| 2005/0103797 | A1 | | 5/2005 | Rader et al. | |
| 2006/0033345 | A1 | * | 2/2006 | Richardson | 292/175 |
| 2006/0038413 | A1 | * | 2/2006 | Rebel et al. | 292/165 |
| 2006/0087128 | A1 | * | 4/2006 | Salice | 292/163 |
| 2006/0091145 | A1 | | 5/2006 | Miller et al. | |
| 2006/0175361 | A1 | * | 8/2006 | Heukamp | 222/534 |
| 2006/0186673 | A1 | * | 8/2006 | Wong | 292/175 |
| 2006/0231555 | A1 | | 10/2006 | Smyers et al. | |
| 2006/0261600 | A1 | * | 11/2006 | Lee | 292/175 |
| 2007/0120376 | A1 | * | 5/2007 | Bella | 292/163 |
| 2007/0194023 | A1 | | 8/2007 | Apps et al. | |
| 2008/0100068 | A1 | * | 5/2008 | Kim | 292/163 |
| 2008/0129054 | A1 | * | 6/2008 | Tremble et al. | E05B 15/102 292/33 |
| 2013/0234450 | A1 | * | 9/2013 | Hobbs et al. | E05C 1/08 292/164 |

FOREIGN PATENT DOCUMENTS

| | | | |
|---|---|---|---|
| EP | 0 485 672 | A1 | 5/1992 |
| EP | 0655391 | A2 | 5/1995 |
| EP | 1 652 646 | A2 | 5/2006 |
| EP | 1472147 | B1 | 9/2006 |
| FR | 2272907 | | 12/1975 |

(56) References Cited

FOREIGN PATENT DOCUMENTS

| | | | |
|---|---|---|---|
| GB | 2425303 | A | 10/2006 |
| GB | 2426237 | A | 11/2006 |
| GB | 2431921 | A | 5/2007 |
| SE | 323908 | | 5/1970 |
| WO | WO-96/40564 | A1 | 12/1996 |
| WO | WO-03/024815 | A1 | 3/2003 |
| WO | WO-03/055753 | A1 | 7/2003 |
| WO | WO-03/059763 | A1 | 7/2003 |
| WO | WO-03/078259 | A1 | 9/2003 |
| WO | WO-2004/080830 | A1 | 9/2004 |
| WO | WO-2004/101376 | A1 | 11/2004 |

OTHER PUBLICATIONS

International Preliminary Report on Patentability in PCT/US05/19352 mailed Feb. 28, 2013.

* cited by examiner

CONTAINER ASSEMBLY AND LATCH APPARATUS, AND RELATED METHODS

CROSS-REFERENCE TO RELATED APPLICATIONS

This Application is a U.S. National filing under §371 of International Application No. PCT/US05/19352, with an international filing date of 3 Jun. 2005, and herein incorporated by reference.

BACKGROUND OF THE INVENTION

The invention relates generally to containers and components thereof, and specifically to apparatus and methods for engaging and disengaging various members of a container or similar apparatus to each other. Although the invention is primarily illustrated in connection with various components of a collapsible container, it has a wide range of potential applications and uses other than for containers.

Prior art bulk containers (especially those that are injection molded or blow-molded or otherwise formed from plastic) sometimes include an option of having one or more sidewalls that either (1) are solid, or (2) include multiple parts moveable with respect to each other. An example of the latter is a sidewall with a fold down access door (or "drop door"). The access door typically is hinged in an opening in the sidewall and can be secured in alignment with the sidewall (by latches or some other interlock).

Prior art bulk containers are sometimes provided in "collapsible" embodiments, so that the sidewalls can be folded down onto the base (or the container can otherwise be flattened), to take up less space when the container is not in use. For such collapsible containers, latches are sometimes used to engage sidewalls with other sidewalls, to help hold those sidewalls in a desired container configuration.

Examples of such containers and drop doors are described in pending U.S. patent application Ser. No. 10/256,631 ('631), filed Sep. 27, 2002. The contents of that '631 application are hereby incorporated by reference to, among other things, provide context and background for the present invention.

Prior to the present invention, container manufacturers who wanted to provide customers with a selection of sidewalls (ones with drop-doors as well as ones without) not only had to manufacture both types of sidewalls, but had to maintain an inventory of both types, sell both types, service and repair both types, etc.

In addition, the latches used in many prior art containers are susceptible to improper insertion or orientation within the sidewall and/or drop door panel. If a latch is inserted "backwards" or otherwise improperly, it may not sufficiently or securely engage the two adjacent parts, risking damage to the container, or to people and/or property around or in the container.

Moreover, many of the latches on a single container typically are different from each other, and must be positioned in a specific location on the container in order to work properly. This is even more true for drop door models, in which latches to engage the drop door to the sidewall are typically different from the latches used to engage the sidewalls to each other and/or to the rest of the container. This results in potential confusion, lost assembly time, and mistakes in assembly (drop door latches may be inserted into sidewall latch positions) both during manufacture and maintenance. It also requires that manufacturers and users (for manufacture, maintenance, and replacement purposes) carry a relatively complex and extensive inventory of latches and related parts.

Prior art latches typically do not provide an optimum balance between (a) ruggedness and security once assembled within the container, and (b) ease of assembly/replacement/maintenance as the need may arise. Among other approaches, prior art designs include interfering tabs behind which the latches must be forced during insertion. The tabs are intended to hold the latch from inadvertently dislodging, while also (at least theoretically) allowing replacement of the latch if necessary. In practice, removal of the latch from behind the tab can be significantly difficult or can even result in destroying the tab or sidewall/drop door itself. If the tab is broken or weakened by such removal (or otherwise is broken during use of the container), the latch typically can no longer be retained in the sidewall or drop door by the tab. Instead, unless the user decides to throw away the entire sidewall or drop door, the replacement latch must be affixed to the sidewall or drop door by some other means, such as by screws, glue, rivets, or the like. Such "permanent" affixation of the replacement latch not only takes more time than is desirable, but makes any subsequent replacement or maintenance on the latch even more difficult and time-consuming.

Further on that point, and specifically regarding collapsible containers, typical prior art latches are not reversible or otherwise usable for both sidewall latching and drop door latching. Such prior art approaches therefore require a separate latch for drop door latching and sidewall latching as those typically operate (pivot) in opposite directions (the drop door pivots outwardly, but the sidewall pivots inwardly).

OBJECTS AND ADVANTAGES OF THE INVENTION

It this therefore an object of the invention to provide a improved apparatus and method for joining pieces into an assembly, in a selective manner. By using a latch apparatus, hinged elements can function in a normal hinged manner with respect to each other, but by inserting a plug or similar element in place of the latch, the hinged elements can be locked to each other. The plug or locking/assembly aspect of the invention can be utilized in a wide variety of applications, including (by way of example) joining two or more pieces to each other even when there is not any hinged relationship between those pieces.

Another object of the invention is to provide improved latch apparatus and methods. Latches embodying the invention are useful in conjunction with the foregoing hinged elements and methods, or in other applications. In the preferred embodiments of the latch, the latch can be readily inserted and manipulated (to engage and disengage two things with each other); and readily removed and replaced/repaired. For embodiments such as described above; the latch preferably can be selectively replaced with a plug member of similar size and shape, to provide a relatively more permanent connection between the two things. Thus, and as described above and herein, one of the many applications in which the invention finds utility in providing the capability to readily convert collapsible containers or other bulk containers from open (drop door or access panel versions) to solid sidewalls, or vice versa.

In one embodiment, the invention provides for a molded bulk container consisting of a base and four sidewalls, where either a sidewall(s) with an access (drop) door or a solid sidewall can be assembled from the same molded components (an open side sidewall and a drop door). The desired configuration can be selected by inserting either door latches (for the access door version) or a latch plug (for the solid sidewall version), and preferably the assembly can be readily converted from either configuration to the other repeatedly, as the user desires or as circumstances demand. The open side sidewall and drop door thus can essentially form a solid sidewall by fixing the drop door in place by means of the plug.

An additional object of the invention is to reduce the number of molds or mold insert and/or eliminate the need to change molds or use mold inserts in the production or manufacturing process, when changing from solid to open side sidewalls (or vice versa). Among its many benefits, certain aspects of the invention permit the same molds (with no change or insert) and the pieces resulting from those mold to be used to make both (a) "solid" sidewalls and (b) access panel/drop door sidewalls.

An additional object of the invention is to provide a convertible container of the aforementioned character, in which the "solid wall" condition can be achieved without the presence of any hinges. Among other things, for customers and/or applications where no need for hinging is anticipated, the "solid" wall assembly can be provided without any hinges (thereby saving on costs, weight, etc. as compared to including a hinge in those "solid wall" embodiments). For such embodiments, the invention preferably includes interfering structures acting between the drop door and the sidewall, such structures engaging each other when inward and or outward forces are applied on the "solid wall" to increase the strength of the assembly. Among other things, these interfering structures can be similar to a tongue-and-groove construction, and can reduce the likelihood that such inward or outward forces might cause a gap between the bottom of the drop door and the confronting top of the sidewall (at the location where the hinge(s) normally would be) or might otherwise cause the sidewall/container to fail under such loading conditions.

By instead using certain embodiments of the invention, manufacturers need only fabricate and inventory (and sell, etc.) the components of the "drop door" version, because those components can be "pinned" to each other using the invention, to form a "solid" (non-drop-door) sidewall. The apparatus and methods of the invention also can simplify and improve the quality and efficiency of manufacture, installation, and removal of latches, such as those associated with separate, hinged and/or adjacent elements.

As indicated, and among other things, the invention can reduce the number of components and/or sub-assemblies needed for various applications. By way of example and not by way of limitation, the latches and/or plugs or other pin members can be used to selectively "fix" components to each other (such as parts of a container sidewall), effectively yielding a "solid" integral assembly from parts that otherwise could move with respect to each other. This can reduce overhead and costs tremendously.

Yet another object of the invention is to provide improved latches. By making latches interchangeable and/or keyed (rather than a custom latch for each location to be latched), the inventory/mold/maintenance costs/etc. are likewise reduced.

Other objects and advantages of the invention will be apparent from the following specification and the accompanying drawings, which are for the purpose of illustration only.

BRIEF DESCRIPTION OF THE DRAWINGS

FIG. 1 shows plugs holding the drop door in a relatively fixed relationship to the sidewall, whereas FIG. 5 illustrates an assembly having latches instead of plugs acting between the drop door and the sidewall);

FIG. 6(*b*) is an enlarged view of the selected portion C of FIG. 5;

FIG. 23(*a*) is a "top" perspective view; FIG. 23(*b*) is a "bottom" perspective view;

FIG. 24(*b*) is similar to FIG. 24(*a*), but shows the sectional elevation view of the latch member of FIGS. 23(*a*)-(*b*), taken along line 24-24 of FIG. 23(*b*).

DESCRIPTION OF PREFERRED EMBODIMENTS

Persons of ordinary skill in the art will understand that the components discussed herein can be fabricated from any of a wide variety of materials and processes. Preferably, the components are lightweight but suitably strong to withstand the loads and forces they may encounter during use. Among others, high/low pressure plastic injection molding, structural foam molding, or blow-molding can be readily utilized to form lightweight components or structures embodying the invention, for storage, transport, and handling of a wide variety of solid and liquid materials and things. Other fabrication methods include, by way of example, compression molding, rotational molding, gas/water assist molding, extrusion, or pultrusion.

For certain of the components described herein, materials such as nylon may be preferable (for certain latch and plug components), while alloy steel may be useful for other latch embodiments. Persons of ordinary skill in the art will understand that other manufacturing processes and materials may be readily utilized.

Additional strength can be introduced into many embodiments of the invention by using engineered grade resins, and/or fillers such as mineral or glass fillers. Preferably, embodiments of the invention are fabricated from strong, lightweight materials sufficient to support substantial loads and forces encountered in transporting and handling relatively heavy materials. For less demanding applications, thinner webs and/or different material may be sufficient.

Although the various embodiments are illustrated in association with drop doors and/or sidewalls for a collapsible container, persons of ordinary skill in the art will understand that the invention has broad utility. A wide range of components other than container components can be joined to each other using latch and plug (or other similar) components of the invention and, if desired, can be readily and repeatedly disengaged from each other (for repair, maintenance, improved access to an assembly's interior, reconfiguration from a hinged relationship to a fixed relationship or vice versa, or the like).

Figure 1:
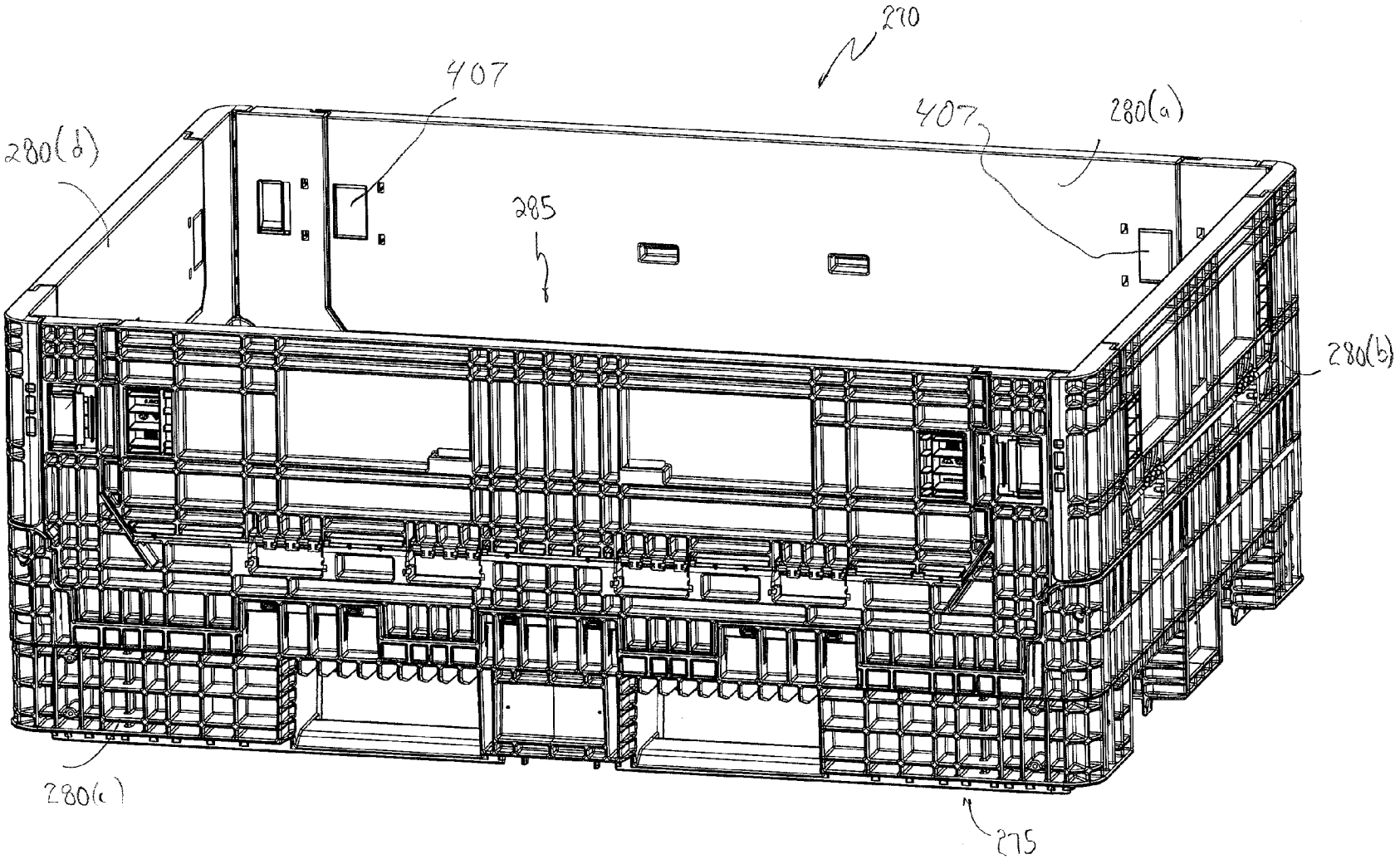
FIG. 1 is a perspective view of a preferred embodiment of a collapsible container incorporating various aspects of the invention, with sidewalls and drop door in their erected positions, configured with the drop doors locked into place with plug members and the sidewalls erected and held in place with releasable latches.

Turning now to FIG. 1, a preferred embodiment of the invention includes a collapsible container 270 having a base 275 and sidewalls 280(*a*)-(*d*) pivotally attached to the base 275. Any suitable means (including those shown generally in FIGS. 1-36) can be used to hinge the sidewalls 280(*a*)-(*d*) to the container 270. One or more of the sidewalls 280(*a*)-(*d*) may further include a drop door 285 pivotally attached, as described herein or otherwise. As illustrated, FIG. 1 is configured with four drop doors locked into place with plug members, but with the sidewalls erected and held in their erected position with releasable latches (as more fully described herein).

The invention also preferably includes one or more latch members and/or plug members, to provide users with ease of assembly and maintenance, as well as flexibility of applications. As described herein, preferably, the plugs and latches are interchangeable with each other, so a user can selectively (a) install and use plugs to lock a drop door into a relatively fixed relationship with a sidewall or lock a sidewall or first element into a relatively fixed relationship with adjacent portions of a container or second element or (b) install and use latches to allow selective erection and/or engagement of those elements with each other via latching and hinging action, as previously described.

For embodiments of the invention involving a drop door within a collapsible bin or container sidewall, the relatively fixed relationship or "solid wall" assembly could have (1) no hinges (just using the plug members), (2) one or more hinges such as those described herein for the hinged version (although any such hinges would NOT be functioning so long as the plug was in place); or (3) other hinges or connecting elements (such as other plug members, not shown) located in or around the location at which the hinges are positioned for the hinged version.

Providing the "solid wall" condition without the presence of any hinges can be useful in many situations. Among other things, for customers and/or applications where no need for hinging is anticipated, providing the "solid" wall assembly without any hinges can save on costs, materials, assembly time, weight, etc. as compared to including a hinge in those "solid wall" embodiments.

Similar concepts apply for embodiments in which plugs hold the sidewalls to the rest of the container. The sidewall can have additional plugs, or no plugs or hinges at all, in place of the hinges shown in the drawings as connecting the sidewall to the base.

In addition to benefits to customers and users in the field (to be able to reconfigure a given container or other assembly from a hinged relationship into a "fixed" relationship), manufacturers can benefit by not having to purchase and maintain molds and inventory for as large a number of parts. By the preferred interchangeability of the latches, fewer "latch parts" have to be made and carried in inventory. The interchangeable plug concepts can even avoid the need for a separate "solid wall" mold and inventory (for those customers/users who do not need or want a drop door configuration, at least not all the time).

In that regard, one or more sidewalls 280(*a*)-(*d*) and/or one or more drop doors 285 preferably includes at least one latch to permit engagement and disengagement between a sidewall 280(*a*)-(*d*) and the container 270 and/or a drop door 285 and a sidewall 280(*a*)-(*d*). As indicated above, certain embodiments of the invention also include at least one plug (preferably interchangeable with the latch, as explained herein) to securely and relatively "permanently" engage items to each other, such as a sidewall 280(*a*)-(*d*) to the container 270 and/or a drop door 285 to a sidewall (a)-(d).

Figure 2:
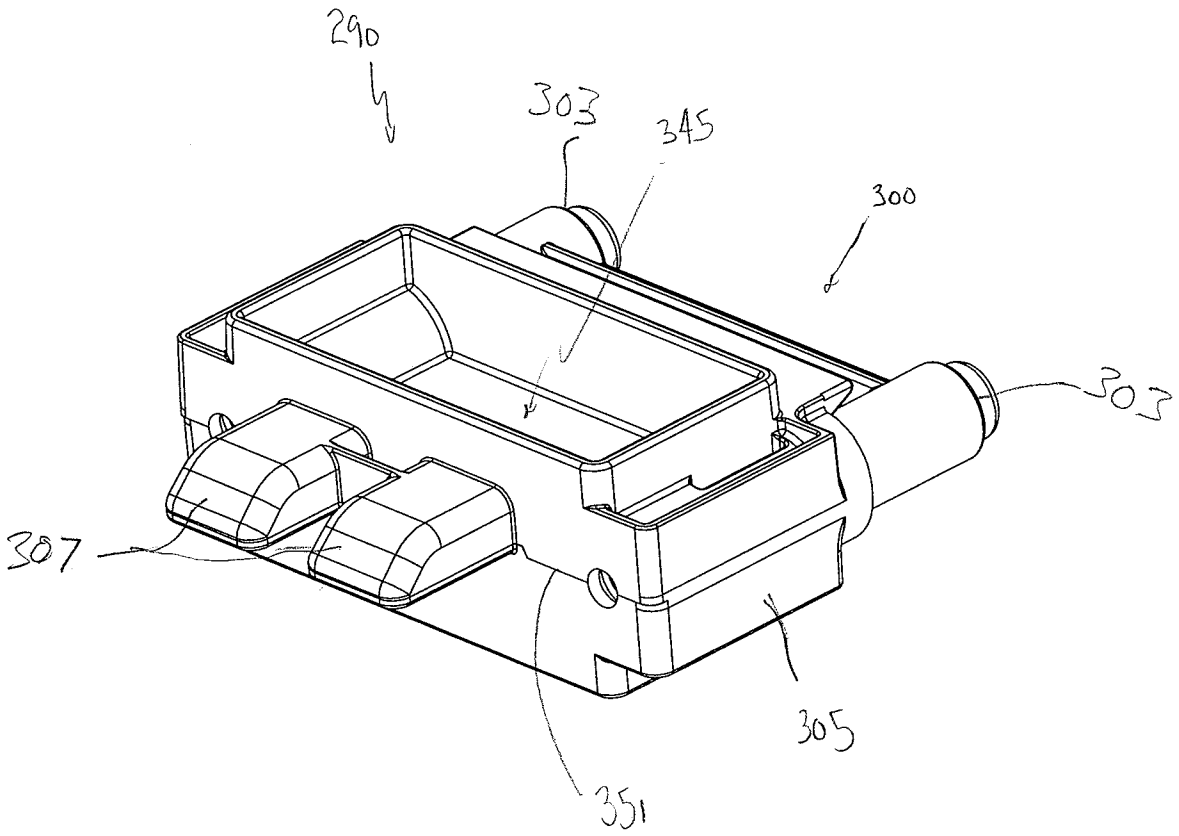
FIG. 2 is a perspective view of a latch useful in connection with sidewall and/or drop door applications such as those shown in FIG. 1.
Figure 3:
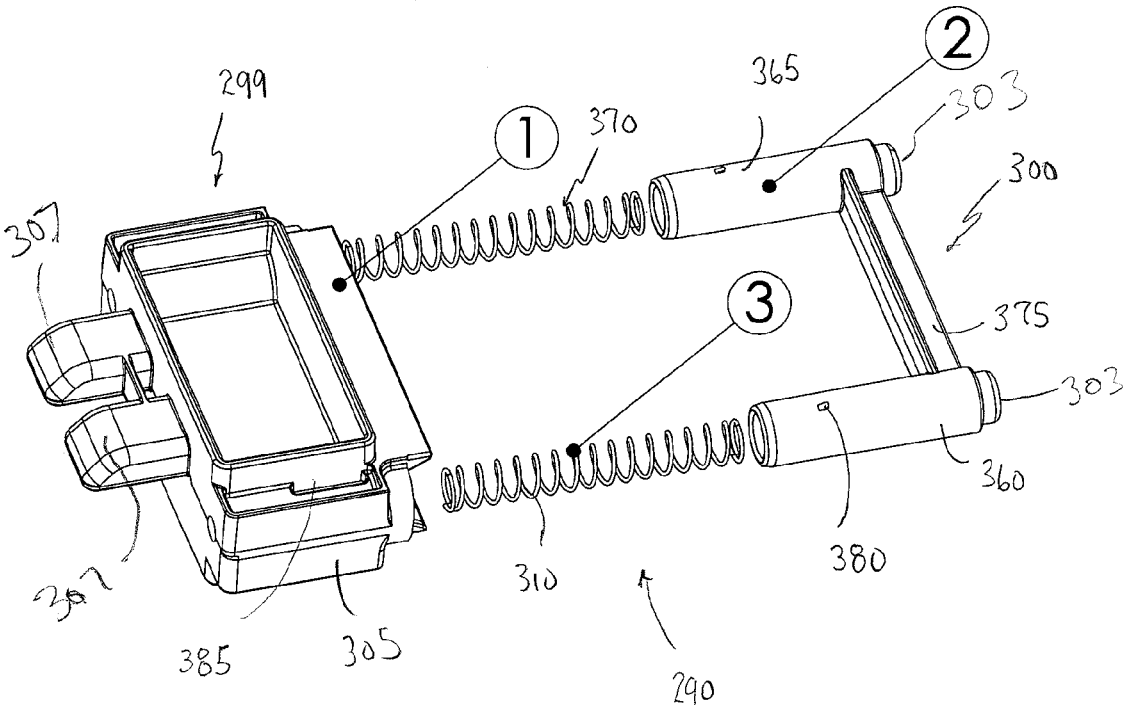
FIG. 3 is an exploded view of the latch of FIG. 2.
Figure 4:
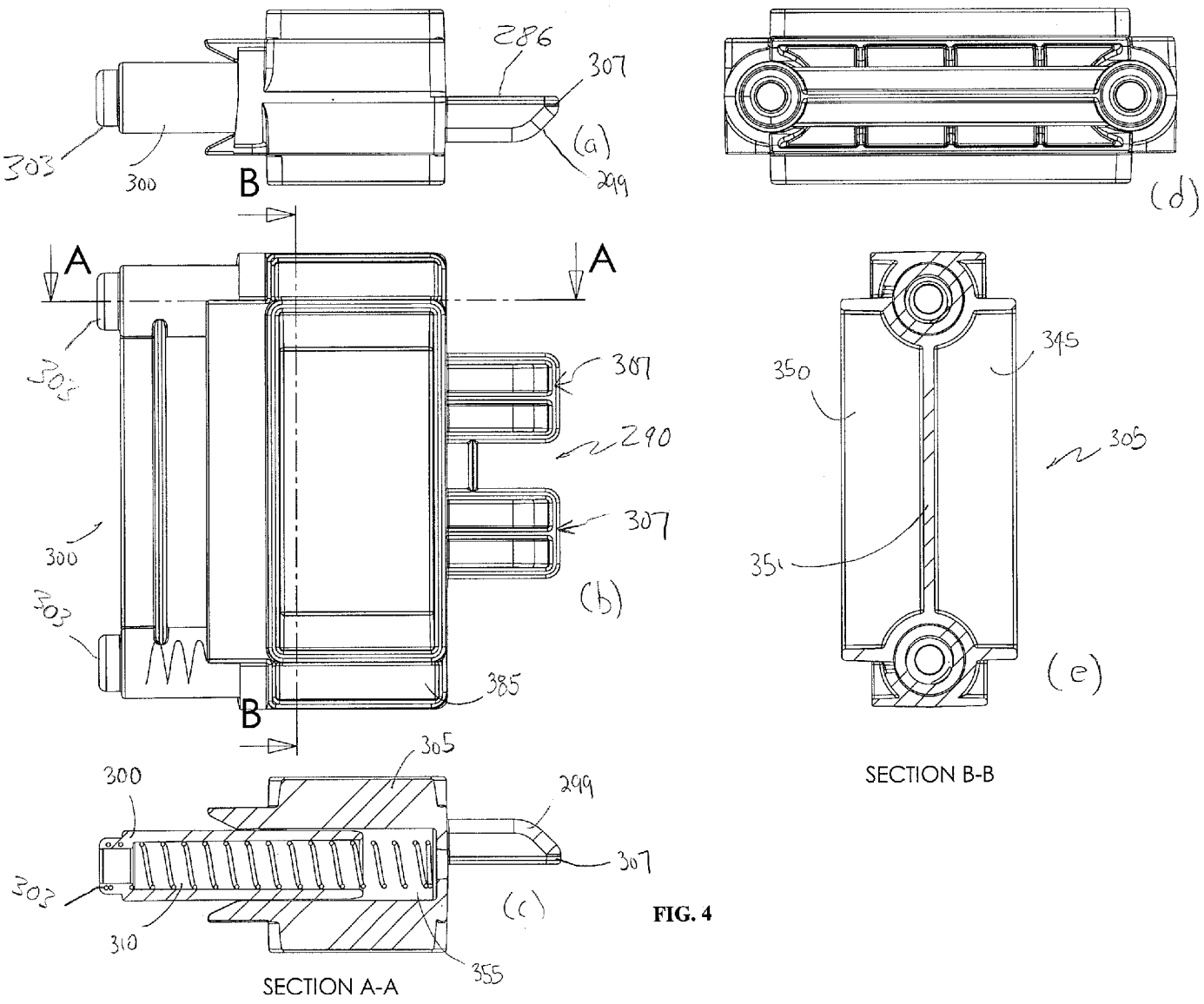
FIGS. 4(*a*)-(*e*) show the latch of FIG. 2 from different views (a—top view; b—side view; c—section view along line A-A of FIG. 4(*b*); d—end view; e—section view along line B-B of FIG. 4(*b*))

As shown generally in FIG. 2 and in more detail in FIGS. 3 and 4(*a*)-(*e*), one of the many embodiments of the invention preferably includes a latch 290 to engage and disengage a first thing to a second thing. The first thing preferably has a pocket or similar area 295 (shown at least in FIGS. 7-14) to removably receive the latch 290 and operatively position it for use as described herein.

Persons of ordinary skill in the art will understand that the latch components discussed herein can be fabricated from any of a wide variety of materials and processes. As with the other components discussed herein, the latch preferably are lightweight but suitably strong to withstand the loads and forces they may encounter during use. Among others, many of the latch components can be fabricated from nylon 6/6, while others (such as the actuating spring) preferably are of alloy steel or similar material. As indicated above, persons of ordinary skill in the art will understand that other manufacturing processes and materials may be readily utilized.

Additional strength can be introduced into many embodiments of the invention by using engineered grade resins, and/or fillers such as mineral or glass fillers. Preferably, embodiments of the invention are fabricated from strong, lightweight materials sufficient to support substantial loads and forces encountered in transporting and handling relatively heavy materials. As with other components discussed herein, for less demanding applications, thinner webs and/or different material may be sufficient.

Although the preferred embodiments are illustrated to include drop doors and/or sidewalls for a collapsible container, persons of ordinary skill in the art will understand that the invention has broad utility. A wide range of components other than container components can be joined to each other using the latches of the invention and, if desired, can be readily and repeatedly disassembled or otherwise disengaged from each other (for repair, maintenance, improved access to an assembly's interior, or the like).

The latch of the invention preferably is fabricated and configured to be removably received in a pocket on one of the things to be latched together. Although the latches described herein could be more permanently affixed to the thing or things to be latched (such as by gluing, welding, or the like), the preferred latching involves a relatively temporary physically fixed relationship between a latch (regardless of whether the latch is termed a first latch, a second latch, etc.) and a pocket (regardless of whether the pocket is termed a first pocket, a second pocket, etc.). In this regard, the pocket 295 and the latch 290 preferably are configured to be assembled so as to facilitate reliable engagement and disengagement of a sidewall 280 to a container 270, and/or drop door 285 to a sidewall 280.

However, as described below, the latch 290 also preferably is easily removed from the pocket 295 (for repair, replacement, or otherwise). Among other things, upon such removal of the latch 290 (or prior to its insertion), the pocket 295 is available to preferably removably receive a "fixed engagement" plug (regardless of whether the plug is termed a first plug, a second plug, etc.). In other words, the latch and plug preferably are sized and shaped to be interchangeable with each other, upon the selection of a user or customer. To further facilitate this interchangeability, the receiving pocket, the latch, and the plug members preferably are configured so that the latch or plug is held or retained in the pocket (against inadvertent or unintentional dislodgment) without any supplemental/additional hardware. The present invention's temporary selectable physical relationship between a latch 290 and a pocket 295, or a plug and a pocket 295 contrasts with conventional latches that are intended to attach to objects in a more permanent physical relationship (such as by glue, bolts, rivets, screws, or like hardware).

As best illustrated in FIG. 3, the preferred latch 290 can be described conceptually as having two body portions 300 and 299 (or a plunger 300 and latch body 299) slidably joined to each other, with a compressed spring element or elements 310 and 370 forcing the two body portions to a normally extended position with respect to each other.

The body portions or first and second members (see below) preferably further include at least one pair of corresponding detent members (such as detents 365 and/or 380 on plunger 300) sized and configured to engage with a corresponding detent (such as track 385 on the latch body 299). Preferably, the detents are engaged or assembled with each other by forcing the plunger 300 into the latch body 299 (with the springs 310 and 370 between them) until the detent 380 pops into the slot 385. The detent 380 can be formed with a sloped or cammed surface on its left side (when viewed in FIG. 3), to facilitate the desired assembly but with a relatively vertical or tooth-shaped right end (again, when viewed in FIG. 3) to preclude inadvertent or unintentional removal or dislodgment of the two body portions. When so assembled, the detent 380 can slide in slot 385 to permit the desired relative sliding motion between the plunger 300 and the latch body 299. Thus, the assembled latch 290 preferably can be collapsed (preferably by hand pressure, pushing the two body portions toward each other and compressing the spring(s) for insertion or removal of the latch into an object or thing such as a sidewall or drop door. The detents can be used to limit the range of compression of the two body portions toward each other, but preferably at least prevent the two body portions from becoming disengaged unintentionally.

Alternatively, the latch 290 can be described as including a first member or tooth element 307, a second member 300, and a central body 305 joined to the first member 307 and movably connected to the second member 300, with a third member 310 urging those two members away from each other. The third member 310, typically a spring or similar device or element, is preferably housed or positioned within the central body 305 to force the second member 300 into engagement with the first thing, and the first member 307 into engagement with the second thing. Persons of ordinary skill in the art will understand that the latch, as well as the plugs and other elements of the invention) can be fabricated and provided in designs and assemblies that are different and/or more complex than those shown and described in detail herein.

The present invention also preferably includes a first pocket 295 on a first thing to removably receive a first latch assembly 290. As shown in the drawings, the latch 290 assembled into the pocket 295 can be readily used for engaging and disengaging a first thing (such as a sidewall 280) to a second thing (such as a container 270). The embodiment in the drawing illustrates a plurality of such pockets 295-298, to removably receive a corresponding plurality of latches 290-293, to further facilitate engagement and disengagement between (a) the sidewall 280 and the container 270 or (b) a drop door 285 with the sidewall 280. Persons of ordinary skill in the art will understand that, in addition, the invention could be described as having a first pocket 295 to removably receive a first latch 290 for engaging and disengaging a drop door 285 to a sidewall 280, and preferably includes at least one more pocket 296-298 to receive at least one more latch 291-293 to further engage and disengage the drop door 285 to the sidewall 280 or the sidewall 280 to other parts of a container 270.

As indicated above, movement of the central body 305 toward the second member 300 preferably compresses the third member 310 to permit engagement and disengagement of the first thing (sidewall 280) from the second thing (container 270), such as by one or more catch elements or teeth 307 being moved into and out of engagement with a corresponding opening on the second thing. Movement of the second member 300 toward the central body 305 preferably also compresses the third member 310 to permit the latch 290 to be inserted and/or removed from the pocket 295.

Figure 5:
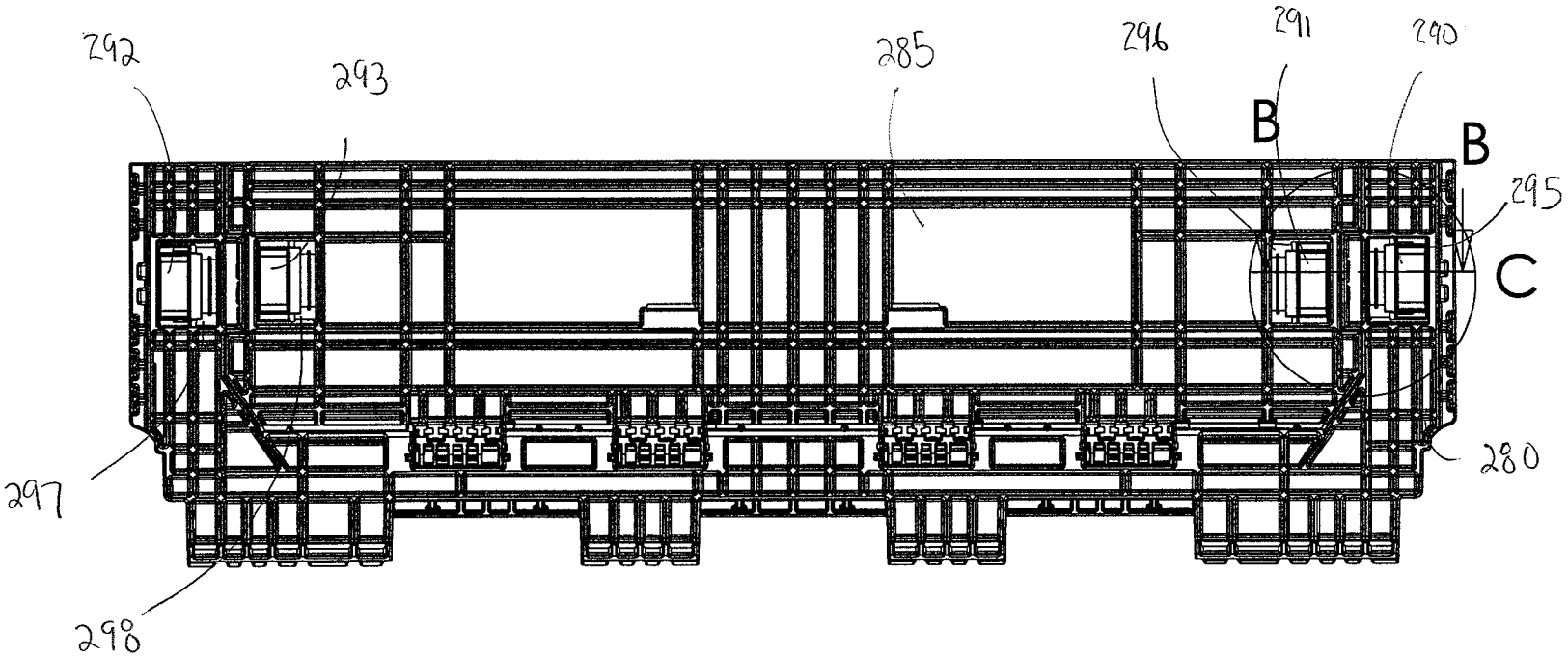
FIG. 5 highlights features of the inventive latch shown in FIGS. 2-4, as it can be used in connection with sidewall and/or drop door applications such as those shown in FIG. 1 (further in that regard.
Figure 6:
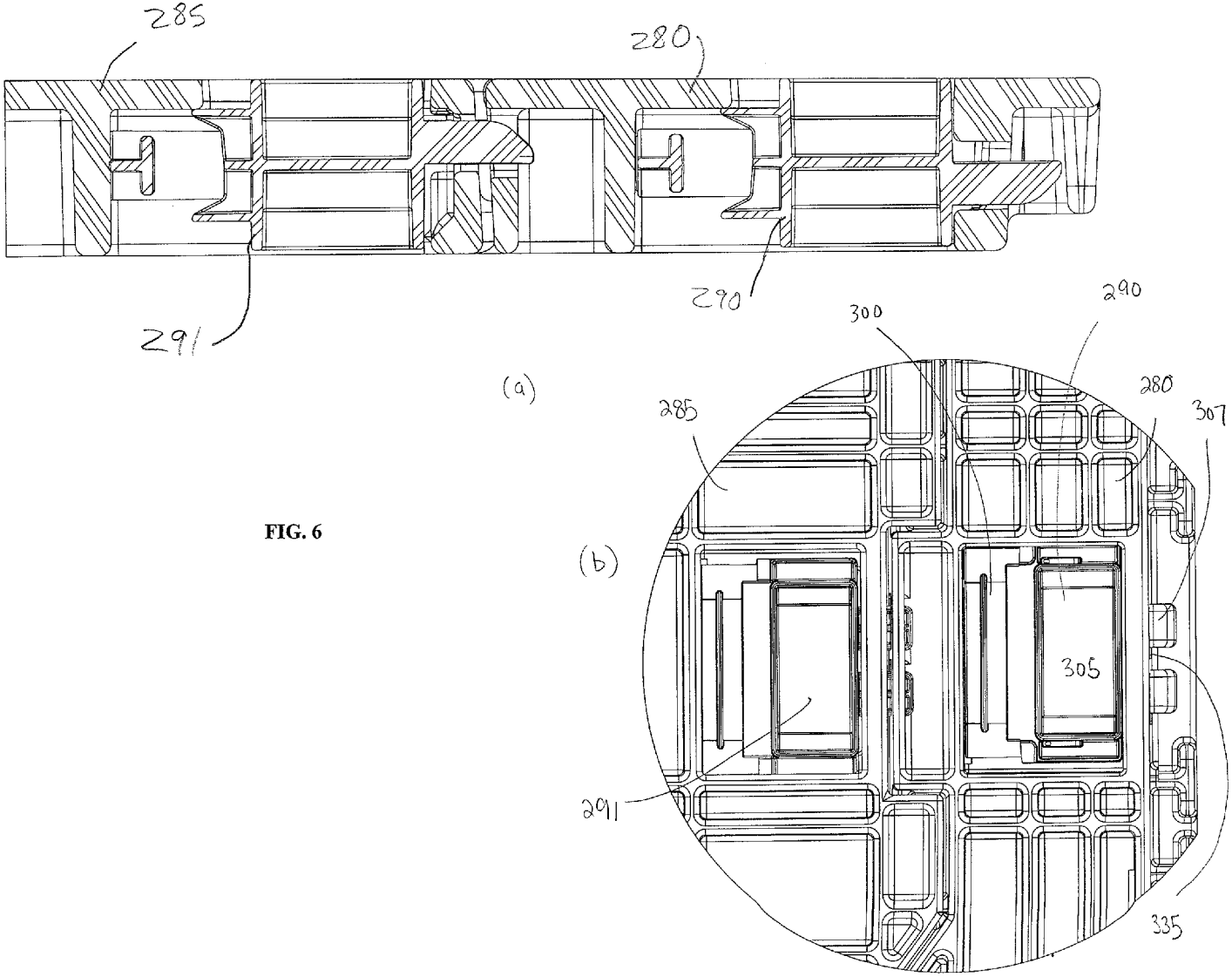
FIG. 6(*a*) is a section view taken along line B-B of FIG. 5.
Figure 7:
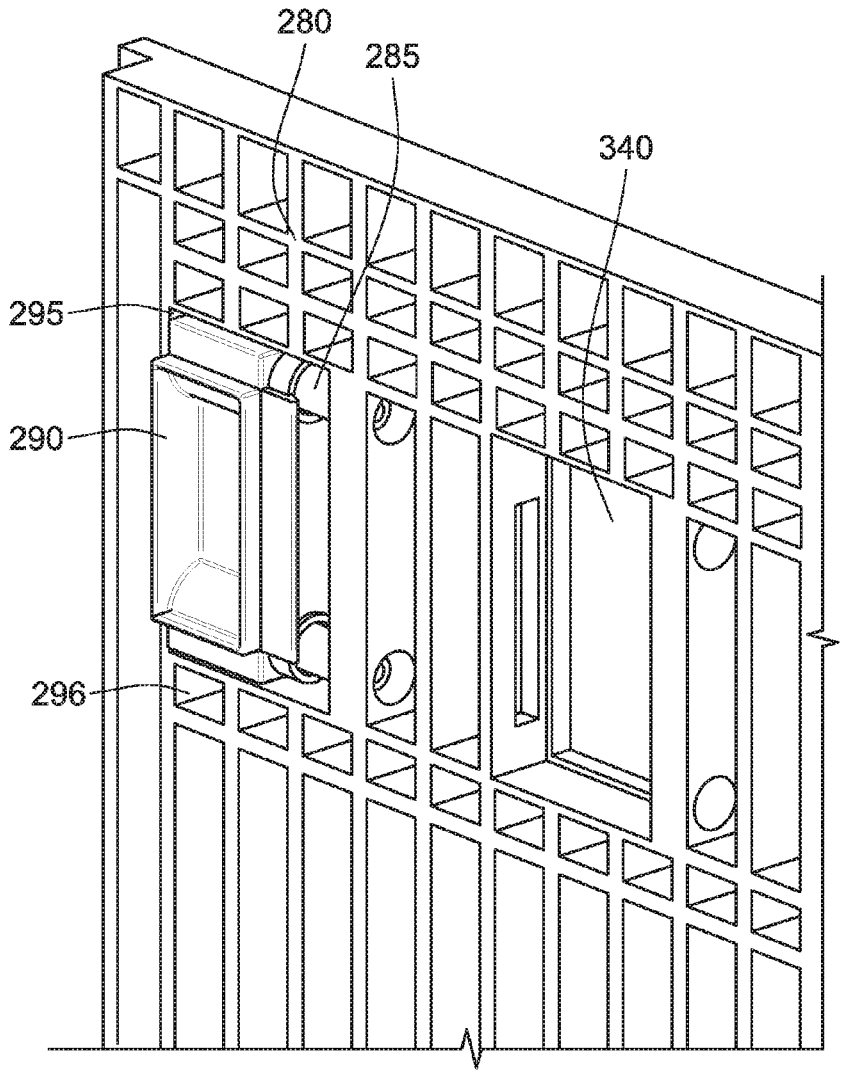
FIGS. 7-14 are perspective views of one of the many embodiments of the invention, illustrating one of the many sequences of movements that can be used to remove and install the latch of FIG. 2 between a corresponding pocket or insertion location of a sidewall and a pocket of a related drop door.
Figure 8:
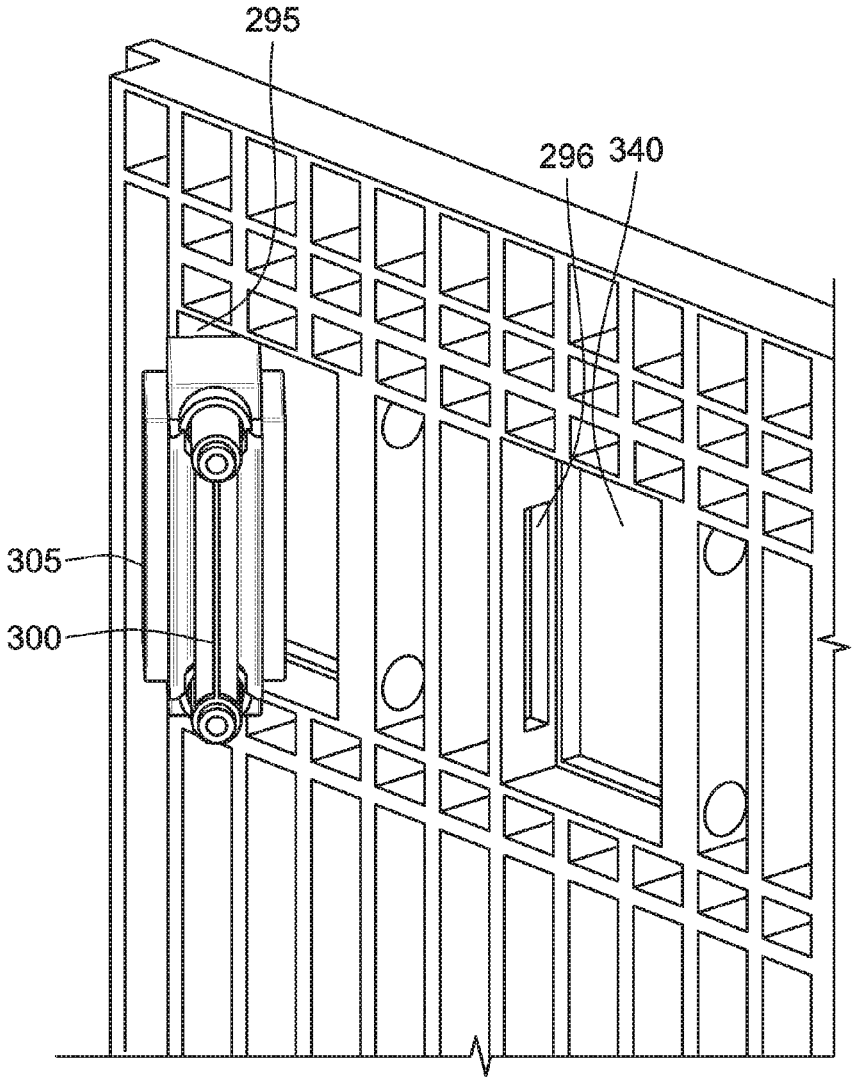
Figure 9:
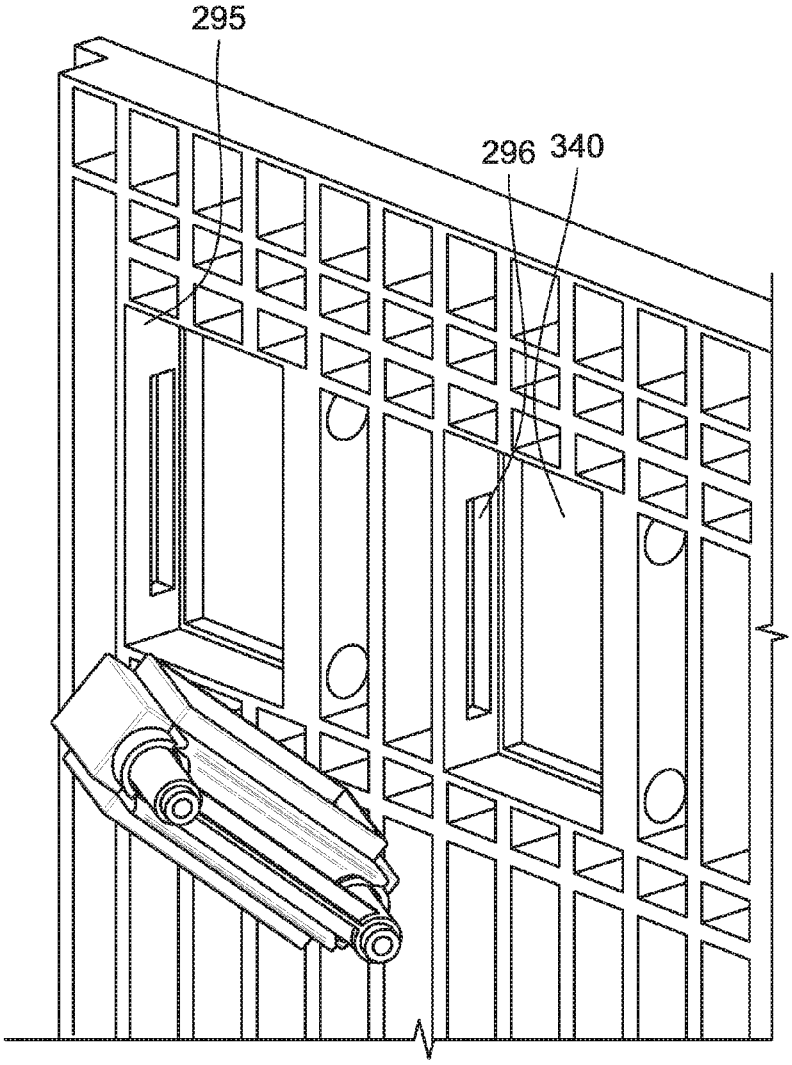
Figure 10:
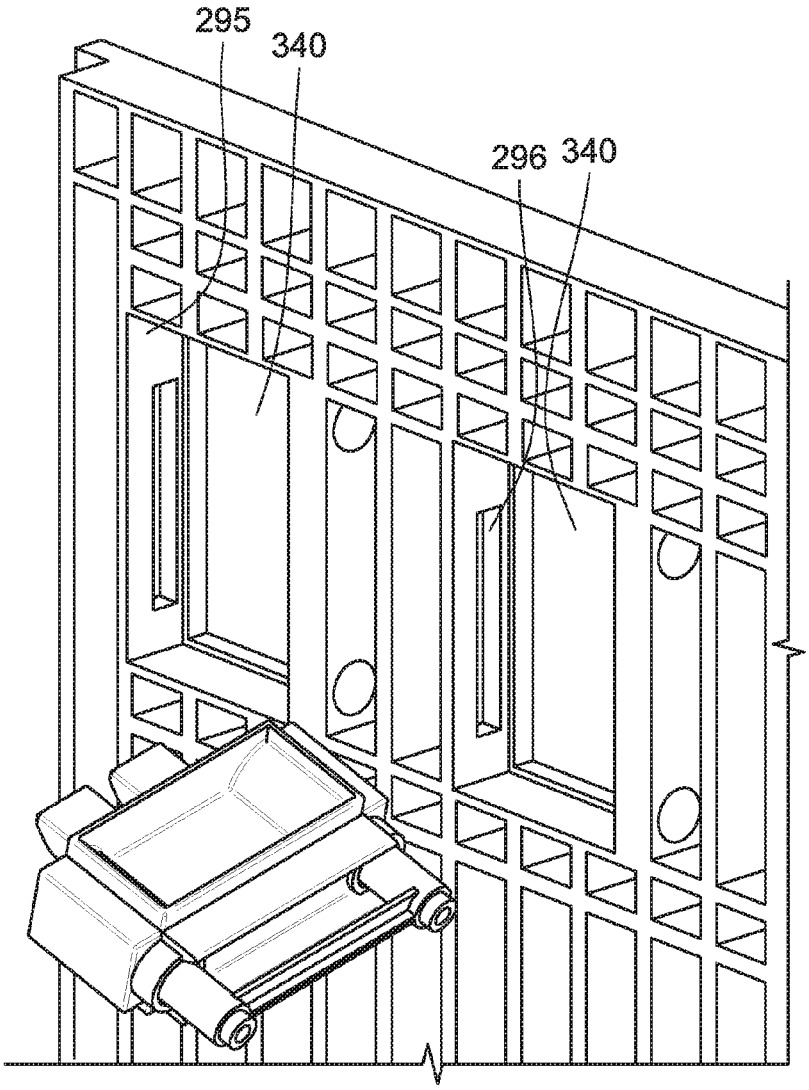
Figure 11:
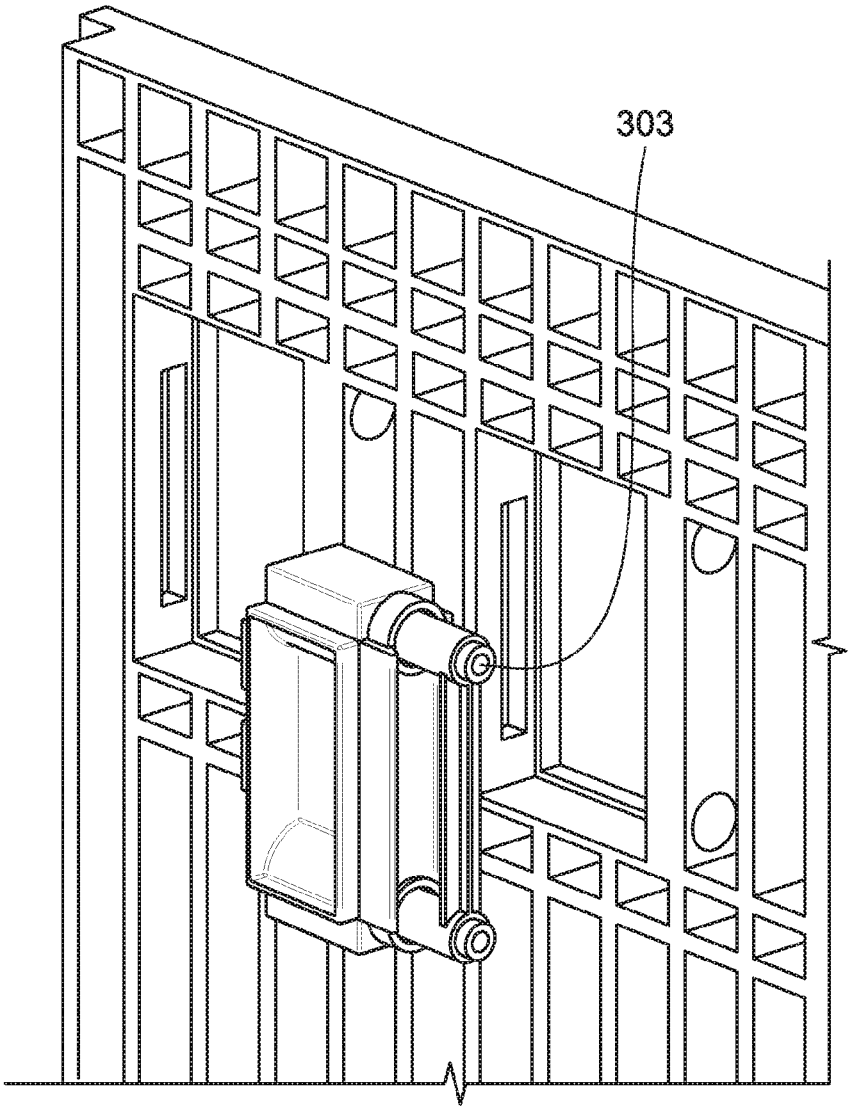
Figure 12:
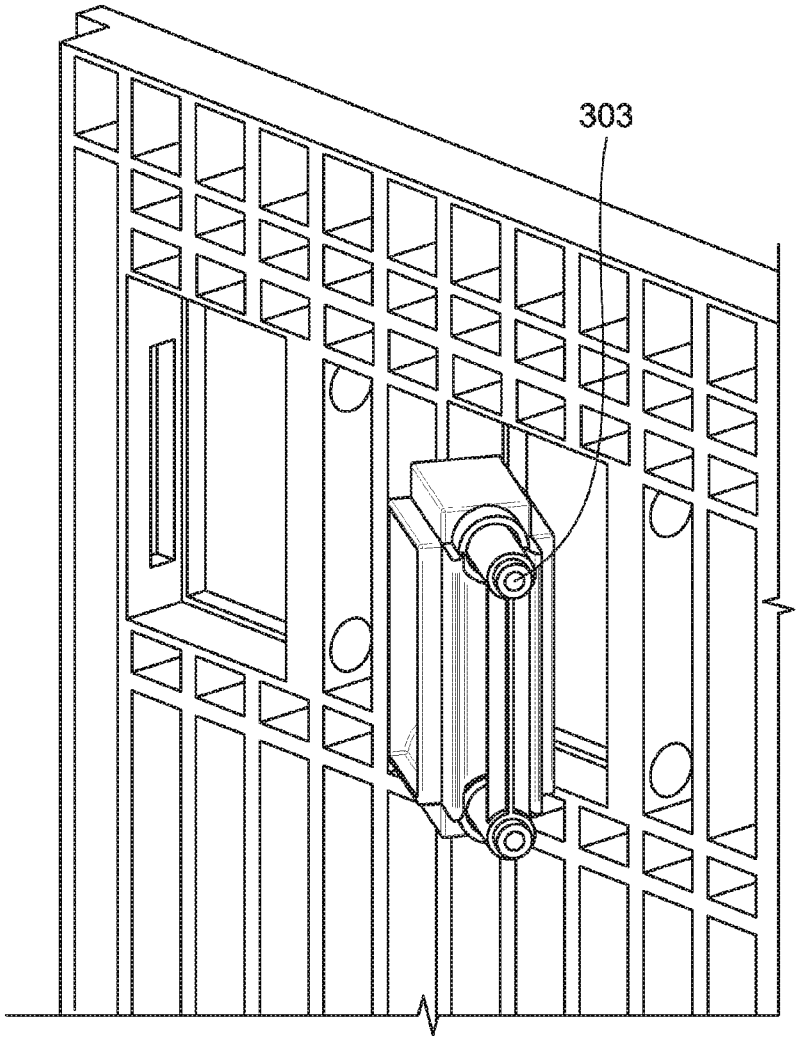
Figure 13:
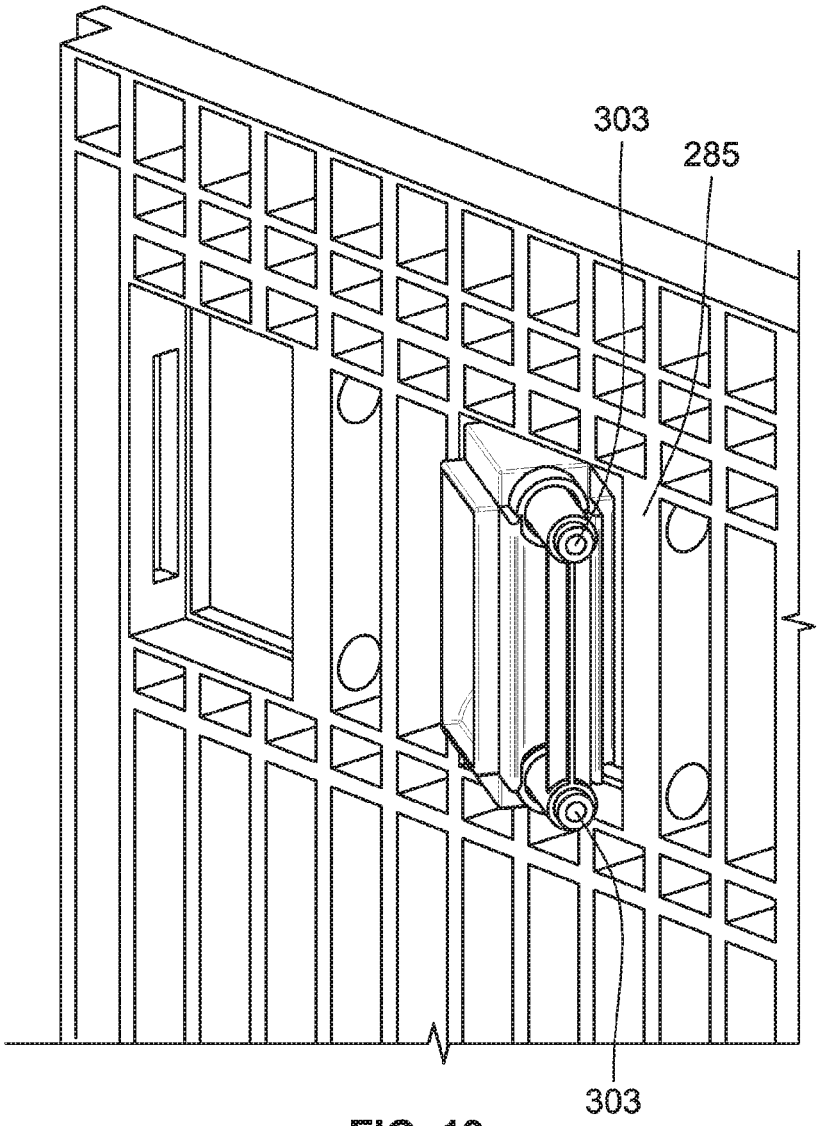

The concepts of relative movement between the first member 307, the second member 300, the third member 310, and the sidewall 280 and container 270 can also be described in reference to FIGS. 5, 6(*a*), and 6(*b*). Those Figures show a sidewall 280 having a drop door 285. The preferred sidewall 280 and drop door 285 each have a latch 290, 291 removably received into a corresponding pocket 295, 296. In this arrangement, the latch on the right hand side of the figure (first latch 290) can be used to engage and disengage the sidewall 280 to another sidewall or other part of a container (not shown in FIG. 5, but such as end wall 280(*b*) in FIG. 1) and the second latch 291 (substantially the same as the first latch 290) can be used to engage and disengage the drop door 285 to the sidewall 280. Other latches including a third latch 292 and fourth latch 293, (substantially the same as the first latch 290 and second latch 291) are preferably included on the opposing end of the sidewall and drop door, respectively, as shown in FIG. 5, and operate in substantially the same way to engage and disengage those respective ends. Thus, in the embodiment of FIG. 5, the sidewall 280 is held in its erected position by two latches 290 and 292 (one at each end of the sidewall), and the drop door similarly is releasably engaged with the sidewall via two latches 291 and 293.

Just as each latch (first 290, second 291, third 292, and fourth 293) preferably is interchangeable (identical or substantially the same), so are each of the pockets 295-298 of the present invention. As explained below, however, the preferred latches and pockets also are "keyed" to help ensure that users install the latches in specific orientations, to provide additional benefits and ease of use. Persons of ordinary skill in the art will understand that this keying is not required and that many benefits of the invention can be realized with no keying (with every pocket being "identical" (capable of receiving an identical latch or plug regardless of its orientation) and a single standard reversible latch/plug configuration could be used in such embodiments.

Accordingly, even for the "keyed" embodiments, each latch 290-293 preferably is capable of being removably received by any of the pockets 295-298 (the keying instead ensuring that the latch is oriented properly, as explained herein). In other words, the latches preferably are interchangeable with each other, as well as will the plugs also described herein.

Said another way, in the preferred embodiment, any latch 290-293 may be received and removed from any pocket 295-298, to facilitate ease of maintenance and assembly, as well as ease of conversion to a "fixed" state (a "uniform" plug preferably can be removably received by those same pockets 295-298). In addition, any "uniform" latch (such as illustrated as elements 290293) can be used to engage and disengage a sidewall 280 to a container 270, or a drop door 285 to a sidewall 280.

The "keying" of the latches is useful for certain applications such as the collapsible containers described herein because of the preferred folding pattern for those products. For many such containers, it is useful to have any drop doors fold outwardly (these doors typically provide access to the contents of the container while it is stacked with other similar erected containers, for example), but have the sidewalls collapse inwardly (so that they fold and stack over each other for ease of handling and shipment in their collapsed state). Among other things, this means that the flat side of the engaging teeth or projections 307 on the latch (the side of the teeth that contacts the other element, not the element that holds the latch within a pocket or similar area) needs to be oriented in one direction for drop doors (outwardly) and the other direction for sidewalls (inwardly). To ensure that the "uniform" single latch is inserted with the proper orientation, it can be keyed (and the receiving pockets similarly keyed), such as by the latch teeth and the pocket holes through which they extend being slightly off center (up or down, when the sidewall is erected). In that example of keying, by forming teeth holes slightly lower than center for the sidewall pockets (the pocket that holds latch 290 in FIG. 6(*b*)) but slightly higher than center for the drop door pockets (the pocket that holds latch 291 in FIG. 6(*b*)). Thus, for a given pair of adjacent latches (such as those illustrated in FIGS. 6(*a*) and 6(*b*)), the teeth holes in the pockets can prevent the latch from being inserted in the wrong orientation. Persons of ordinary skill in the art will understand that the other side of the door/sidewall combination (on the left side of FIG. 5, for example) might reverse the "off-center" positions of the sidewall and drop door pockets (so that the drop door teeth holes are lower than those on the sidewall) and that any suitable manner of keying, or combinations of ways of keying, may be utilized.

For ease of describing this aspect of the invention, latches, pockets, and plugs are each identified herein as being a first, a second, a third, etc., such element. However, persons of ordinary skill in the art will understand that these designations are not meant to limit, for example, a particular latch (first latch 290) to a particular pocket (first pocket 295), or even the number or location of those elements within a given application. Certain benefits of the invention can be realized, for example, for applications involving a single latch/plug/pocket.

The general principles of actuation and design of spring-actuated latches is known (in collapsible containers and other applications), and some of those concepts exist in the present invention as well (springs urge the engaging teeth outwardly, the teeth can automatically retract and reextend to engage between the elements, just by pushing the two elements together, etc.), although the present invention includes a number of features not present in existing latches. Returning now to FIG. 6(*b*), the first latch 290 is shown in the condition of being held or removably received by a first pocket 295. The first member 307 preferably includes or constitutes at least one tooth- or finger-like projection extending from the central body 305 that is inserted into a corresponding cavity or tooth-receiving opening 335 of the container 270. The first member or members 307 preferably protrude from the cavity 335 and contacts the container 270 during engagement of the sidewall 280 to the container 270. As shown in FIG. 4(*c*), the preferably projection 307 is joined to the central body 305 such that movement of the central body 305 toward the second member 300 compresses the third member 310 and draws the projection 307 far enough away from the container 270 to disengage the projection 307 from the container 270. However, the projection 307 preferably is not drawn far enough to disengage the projection 307 from the corresponding cavity 335.

In the preferred embodiment, a user can operate the latch (once it is assembled into a receiving pocket) by moving the central body 305 toward the second member 310 from either side of the sidewall 280. This useful bi-directional access is preferably facilitated by the provision of openings through the sidewall or drop door in which the latch is mounted. Each of the four latch pockets in FIG. 5 preferably includes such an opening. For example, a window 340 (shown in sequential FIGS. 7-14) is formed in the first pocket (the one in which no latch is yet assembled in FIG. 7), and the latch 290 preferably includes a first recess 345 (shown in FIG. 2) positioned on one side of the central body 305 and a second recess 350 positioned on the opposite side of the central body 305. The recesses 345 and 350 preferably are separated from each other by a central web 351 and are at least approximately both the same size and shape (to facilitate the use of the latch in multiple orientations, for example, as described herein), although the gripping functionality provided by those recesses (described herein) can be provided in any suitable manner. The window 340 provides an opening for an end user to grasp one of the recesses 345, 350 and manually move the central body 305 toward the second member 300 to compress the spring 310, facilitating engagement and disengagement of the sidewall 280 and the container 270.

Preferably, the window 340 is large enough to allow the user to actuate and/or grasp the central body 305 (to permit the user to readily release the latched elements from each other). In this regard, preferably movement of the central body 305 toward the second member 300 is permitted. However, movement of the second body 300 toward the central body 305 preferably is prohibited or at least not as easy for a user to accomplish (thus helping to reduce the likelihood of inadvertent removal of the latch entirely from the pocket). Although the central body 305 may be actuated or moved from either side of the sidewall 280 (to engage and disengage the sidewall 280 from the container 270), in the preferred embodiment the first latch 290 may only be inserted into or removably received by the first pocket 295 from one side of the sidewall 280 (the outside, as the container is viewed when erected).

The preferred insertion and removal of the latch into a given pocket is also facilitated by collapsing the spring and other latch members toward each other, but preferably is not likely to occur during normal user actuation of the latch to engage or disengage the sidewalls, drop doors, or other components with each other. As shown in FIG. 4(*c*), the second member 300 of the latch 290 is preferably positioned within a central body chamber 355 of the latch body 305. Preferably, this sliding relationship (useful to permit the engagement/disengagement of the latched elements when a user presses latch body 305 toward second member 300) also permits a user to move the second member 300 toward the central body 305 a distance sufficient to allow the second member 300 to disengage from corresponding retaining structures/elements in the sidewall 280. This permits the first latch 290 to be inserted into or removed from the first pocket 295 (or any similar latch to be inserted or removed in any similar pocket). Movement of second member 300 toward the central body 305 and/or the central body 305 toward the second member 300 preferably is limited (to avoid undo compression of the latch spring(s) or other potential failure of the latch) by the central body 305 contacting the end of the second member 300 housed within the central body chamber 355.

As indicated above, and as further shown in FIGS. 4(*a*)-(*b*), the first member 307 preferably is keyed (or positioned or offset) from one of the horizontal and/or vertical centerlines of the central body 305. As also mentioned above, this allows the invention to help ensure against improper assembly/orientation of a latch in an application such as a collapsible container (such misorientation could have dangerous consequences, such as the container collapsing when loaded, etc.). In such "keyed" embodiments, the first latch 290 can be configured so that, to be inserted into (or "removably received by") the first pocket 295, the first member 307 requires insertion into the corresponding cavity 335 in a predetermined alignment.

In addition, the first member or tooth 307 preferably has an asymmetric shape, shown for example in FIGS. 4(*a*) and (*c*), such that during engagement of the sidewall 280 to the container 270 a sloping or seating surface 299 on the first member 307 initially contacts the container 270, forcing the central body 305 to move toward the second member 300, collapsing the latch 290, and permitting the first member 307 to engage the container 270 (whereupon the latch spring 310 forces the teeth 307 back out into interfering engagement with the container 270).

Figure 14:
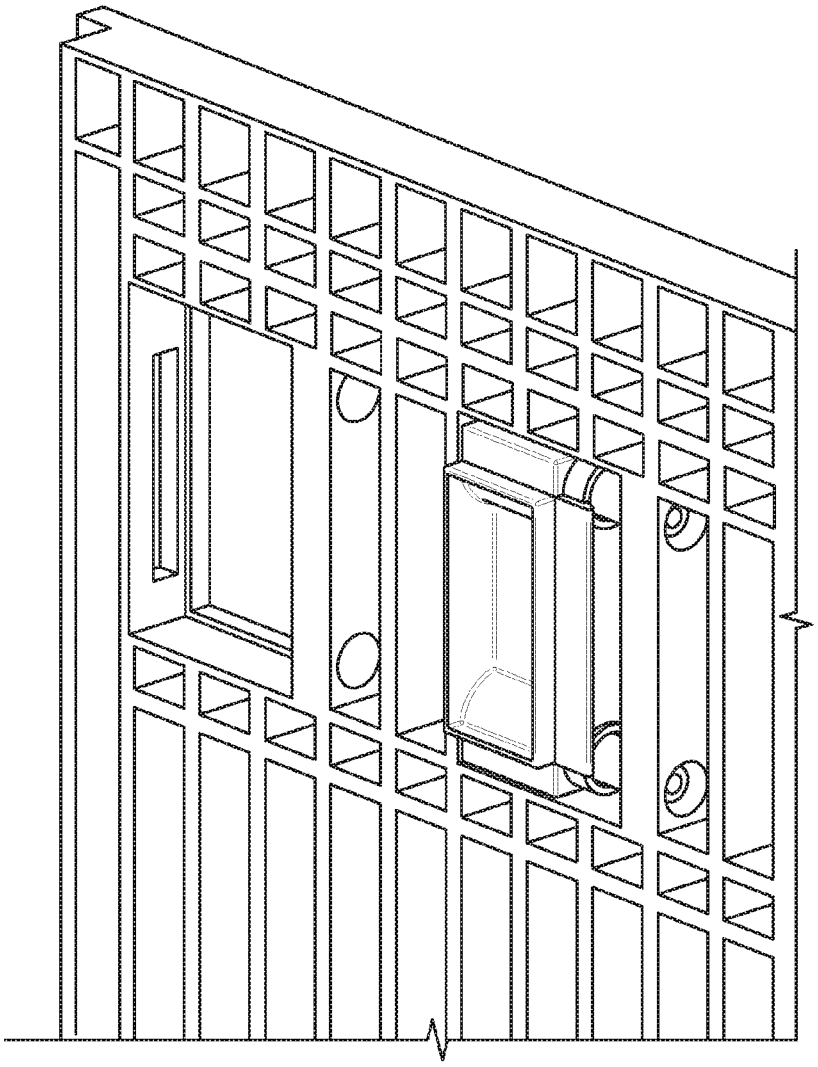
Figure 15:
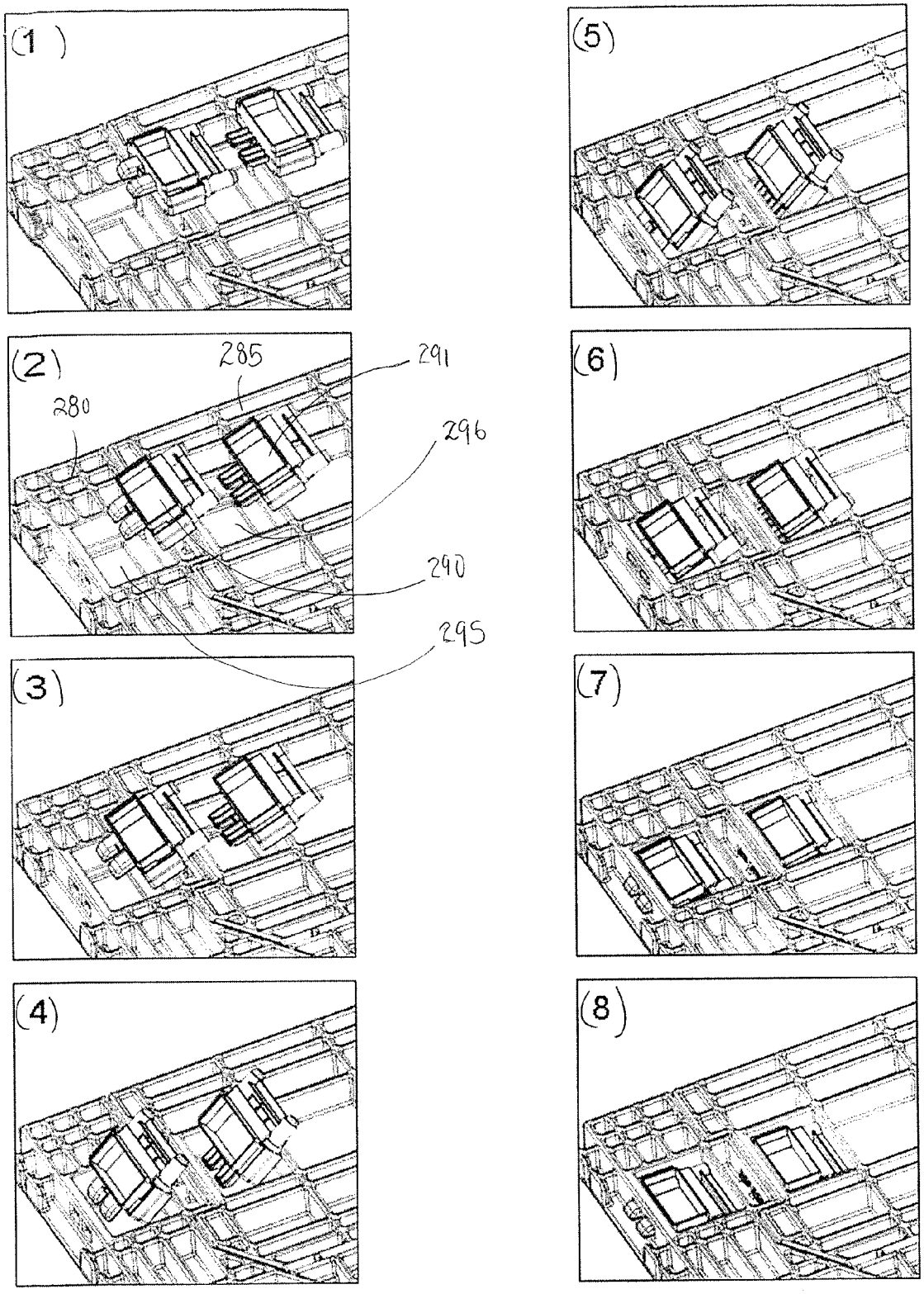
FIGS. 15(1)-(8) are similar to FIGS. 7-14, and illustrate one of the many uses and methods of assembly of the latch of FIG. 2 with pockets of a sidewall and/or a drop door.

As shown in sequential FIGS. 7-14, the above described "keyed" attributes of one embodiment of the inventive latch provide for a first latch 290 that preferably (1) can be removably received by the first pocket 295 in a predetermined alignment to engage and disengage the sidewall 280 from the container 270 (see FIG. 7), (2) can be disengaged from the first pocket 295 by moving the second member 300 toward the central body 305 (see FIG. 8), (3) can be rotated to align the teeth or first members 307 with a corresponding cavity of a second pocket 296 (see FIGS. 9-12), (4) can be removably received by the second pocket 296 by moving the second member 300 toward the central body 305 to permit the latch's teeth to be inserted into the drop door 285 prior to swinging the second member 300 into engagement with the drop door 285 (see FIG. 13), and (5) the second member 300 is then swung into engagement with the drop door 285 and the latch is released by the person inserting same so that the distal ends 303 of the second member 300 engage corresponding detents or holes formed in the drop door, thereby helping retain the latch in its engaged relationship with the drop door and resulting in the latch 290 being "removably received" by the second pocket 296 (see FIG. 14).

As explained above, in the collapsible container example of the drawings, the desired rotating of the first latch 290 (from its orientation in the first pocket 295) to align the first latch 290 with the second pocket 296, means that the alignment of the first member 307 in the second pocket 296 differs from the alignment of the first member 307 in the first pocket 295. For example, sequential FIGS. 15(1)-(8) show the preferred arrangement or direction of the asymmetric catch or teeth or first member 307 when removably received by the first pocket 295 (high and to the left) compared to being removably received by the second pocket 296 (relatively lower and to the right of the latch's centerline).

Accordingly, in one embodiment shown in FIG. 1, when erecting the sidewalls 280(*a*) and 280(*c*) to form the container 270, the sidewall 280 is pulled in a direction away from the center of the container 270 such that the preferably sloped or curved shape 299 of the first member 307 is the first portion of the latch that contacts the end walls 280(*b*) and 280(*d*) of the container 270. As noted above, this preferably forces the central body 305 to move toward the second member 300 and permits the first member 307 to engage the container 270, thereby forming the container/sidewall assembly. Persons of ordinary skill in the art will understand that first member shapes other than the curve 299 shown in the figures may be utilized to urge or move the central body 305 toward the second member 300. As mentioned above, to disengage the sidewall 280 from its latched relationship with the rest of the container 270 (the end wall 280(*b*), for example), the user can move the latch's central body 305 toward the second member 300.

As noted above, when engaging the drop door 285 to the sidewall 280, the drop door 285 normally is pushed in a direction toward the center of the container 270 (rather than away from the container center, as with the sidewall), such that the preferably curved surface or shape 299 of the first member 307 makes the initial contact with the sidewall 280. Given sufficient force on the drop door (applied by the user raising the drop door into its closed position) this preferably forces the latch's central body 305 to move toward the second member 300, permitting the catch or first member 307 to engage the sidewall 280 (thereby closing the sidewall/drop door assembly into a planar position). Likewise, to disengage the drop door 285 from the sidewall 280, the user moves the latch's central body 305 toward the second member 300 (thus retracting the catch or teeth from engagement with the sidewall 280).

Persons of ordinary skill in the art will understand that various other applications of the invention and arrangements of the pockets 295-298 and corresponding latches 290-293 (not shown) can allow latched/hinged elements such as the sidewall 280 and the drop door 285 to be closed in the same direction or in opposite directions (toward or away from the center of the container 270) relative to each other.

Returning to FIG. 3, the second member 300 preferably includes a first arm 360 operatively engaged with or even connected to the third member 310 and a second arm 365 operatively engaged with or even connected to a fourth member 370 (typically a spring or other force-generating/compressible/retractable device substantially the same as or identical to the spring or other force-generating/compressible/retractable device used as the third member 310). In one embodiment, the position and function of the third member 310 and fourth member 370 are 23 substantially the same with regard to the central body 305. Accordingly, the fourth member 370 is positioned within the central body 305 to force the second arm 365 into engagement with the sidewall 280, and the first member 299 into engagement with the container 270. The first arm 360 and the second arm 365 are preferably connected by a bridge 375 to permit uniform/coordinated movement of the second member 300 toward the central body 305.

As noted above, the bridge 375 also can ensure proper alignment of the detents 365 and/or 380 into the corresponding slots 385, and those detents permit a restricted range of sliding motion between the plunger or second member 300 toward the central body 305 and restrict movement of the second member 300 away from the central body 305 (such as when the first latch 290 is removed from the first pocket 295 or is otherwise not engaged in a retaining pocket or similar structure).

Figure 23A:
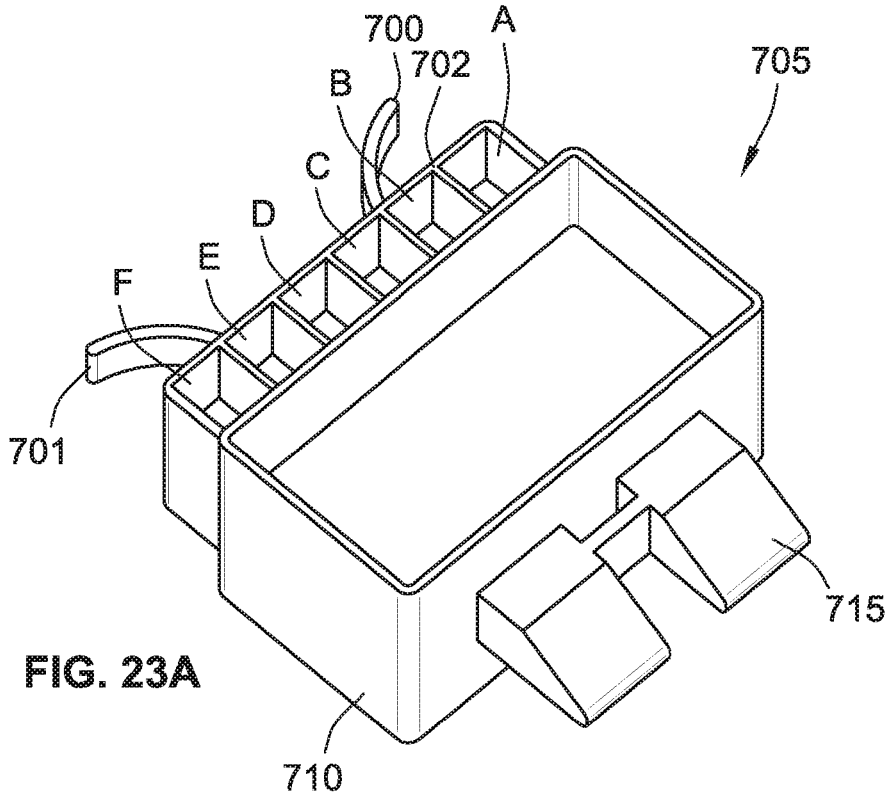
FIGS. 23(*a*)-(*b*) show yet another of the many alternative embodiments of a latch member have a flexible appendage or leaf spring rather than the rear barrel sections and springs of the latch of FIGS. 2-3.
Figure 23B:
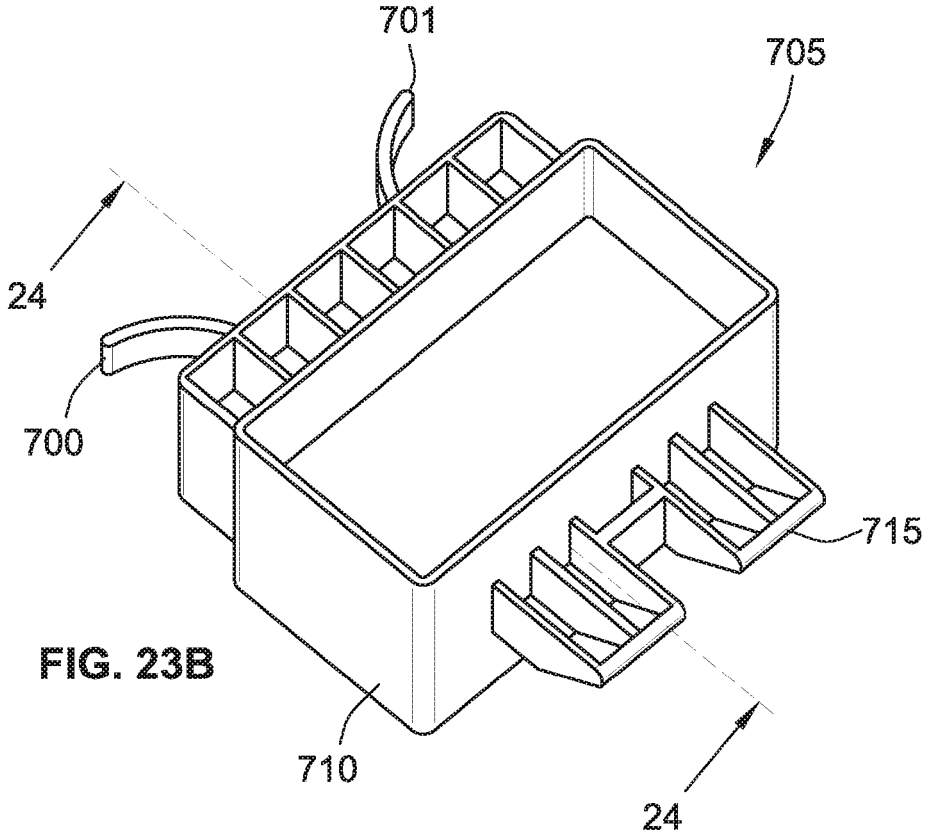

One of the many alternative embodiments of the invention is illustrated in FIGS. 23(*a*)-(*b*), and 24(*a*)-(*b*). In those Figures, the retractable second member 300 of FIG. 3 may be replaced with at least one flexible appendage(s) 700, 701 integrally molded with the central body 305. The flexible appendages 700, 701 or "leaf springs" (similar to the preferred spring 310, 370 used in other embodiments) can be described as a force-generating/compressible/retractable device.

Persons skilled in the art will understand the basic material construction, device configuration and operation of the latch 705 shown in FIGS. 23(*a*)-(*b*), minus at least the central body chambers 355 that houses the spring elements 310, 370, is similar to the latch 290 shown in FIGS. 2-4. In other words; the latch 705 preferably includes a body portion 710, a first member or tooth element 715 with associated "keying" attributes, and is removably received by a pocket 290293 to allow engagement and disengagement of a first thing to a second thing.

In this regard, insertion and removal of the latch 705 is preferably accomplished by placing the flexible appendages 700, 701 or "leaf spring" into a corresponding sidewall pocket, as described herein, flexing the flexible appendages sufficiently to allow the tooth elements 715 to be received into the sidewall pocket, and releasing the latch so that the tooth elements 715 are urged into their respective orifices within the sidewall and held in place by the material memory and/or flexing of the leaf springs 700, 701. The latch 705 can now be gripped and flexed backward (to open a door or sidewall) and will be urged forward by the appendages 700, 701 (to latch or secure a door or sidewall).

In contrast to the multiple piece construction of the latch 290 embodiment shown in FIGS. 2-4, the latch 705 shown in FIGS. 23(*a*)-(*b*) preferably features a one-piece construction that typically reduces weight, complexity of operation, and production costs due to the reduced number of components when compared to the other latch embodiments described herein. The latch 705 preferably is made by injection molding or similar process, but can be fabricated by any of a wide range of suitable methods and from any suitably strong material.

Figure 24A:
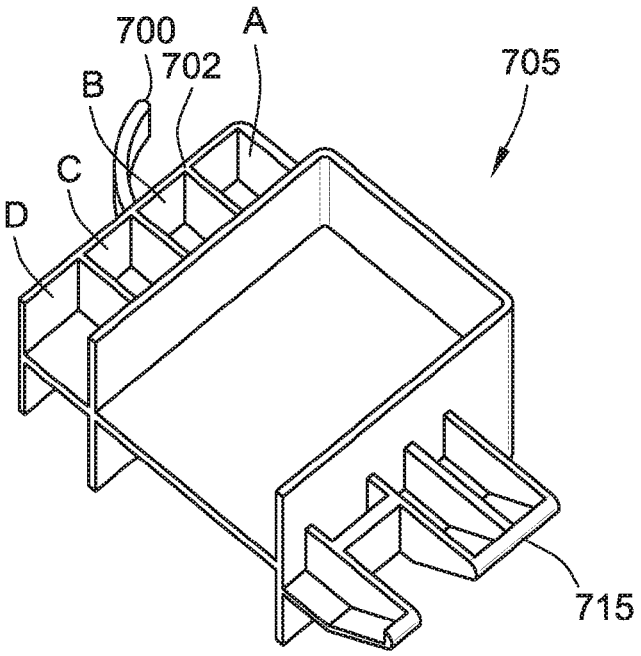
FIG. 24(*a*) show a sectional view of the latch member of FIGS. 23(*a*)-(*b*), taken along line 24-24 of FIG. 23(*b*)
Figure 24B:
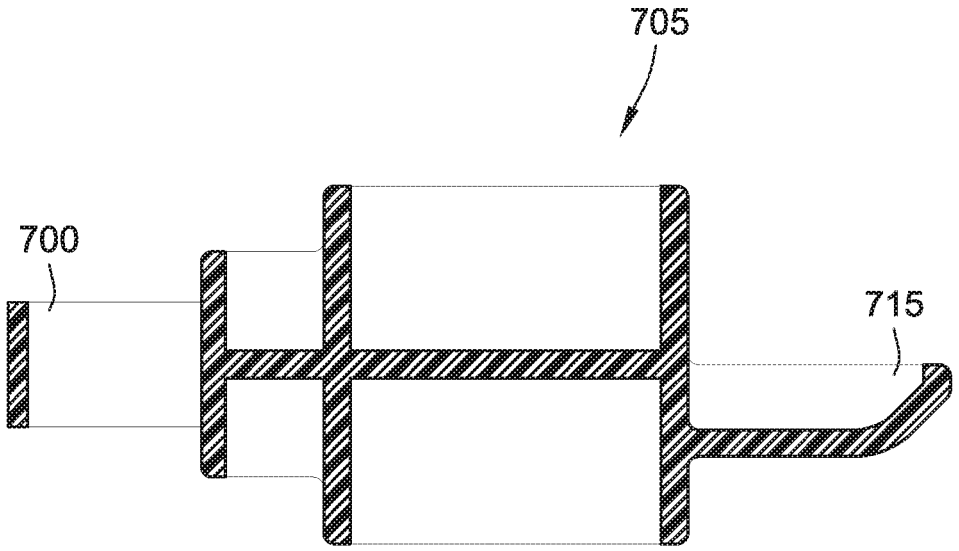

FIGS. 24(*a*)-(*b*), show a perspective cut-away view and a cross-sectional view of the latch shown in FIGS. 23(*a*)-(*b*). As shown in those figures, preferably the latch 705 includes a plurality of ribs or other elements forming molded compartments "A-F" as part of the single-piece latch assembly. Typically, these compartments "A-F" and associated compartment dividers, such as compartment divider 702 between compartments A and B, provide structural support or rigidity and/or gripping surfaces for the latch body. Persons of ordinary skill in the art will understand that the latch body and the addition or lack of any compartments will typically depend on, among other things, the intended application of the latch and any related stress or lack thereof the latch may experience.

The present invention also preferably may include one or more plug elements interchangeable with the latch elements described herein, to more permanently "fix" two elements to each other. Using the primary example of the attached drawings, a first single piece plug 390 can be used to securely engage the first thing (sidewall 280) to the second thing (container 270) or a drop door 285 to a sidewall 280. Preferably, the first plug 390 can be selectively inserted into or be removably received by the first pocket 295 (or any similar plug can be inserted into any similar pocket/retention area), upon removal of the first latch 290 or if the pocket is otherwise empty. Thus, rather than requiring a variety of different plugs and/or latches, a plurality of similarly sized and shaped plugs and/or latches can be produced and/or used (or held in inventory for sales or maintenance, etc.) by manufacturers, distributors, users, etc.

Figure 16:
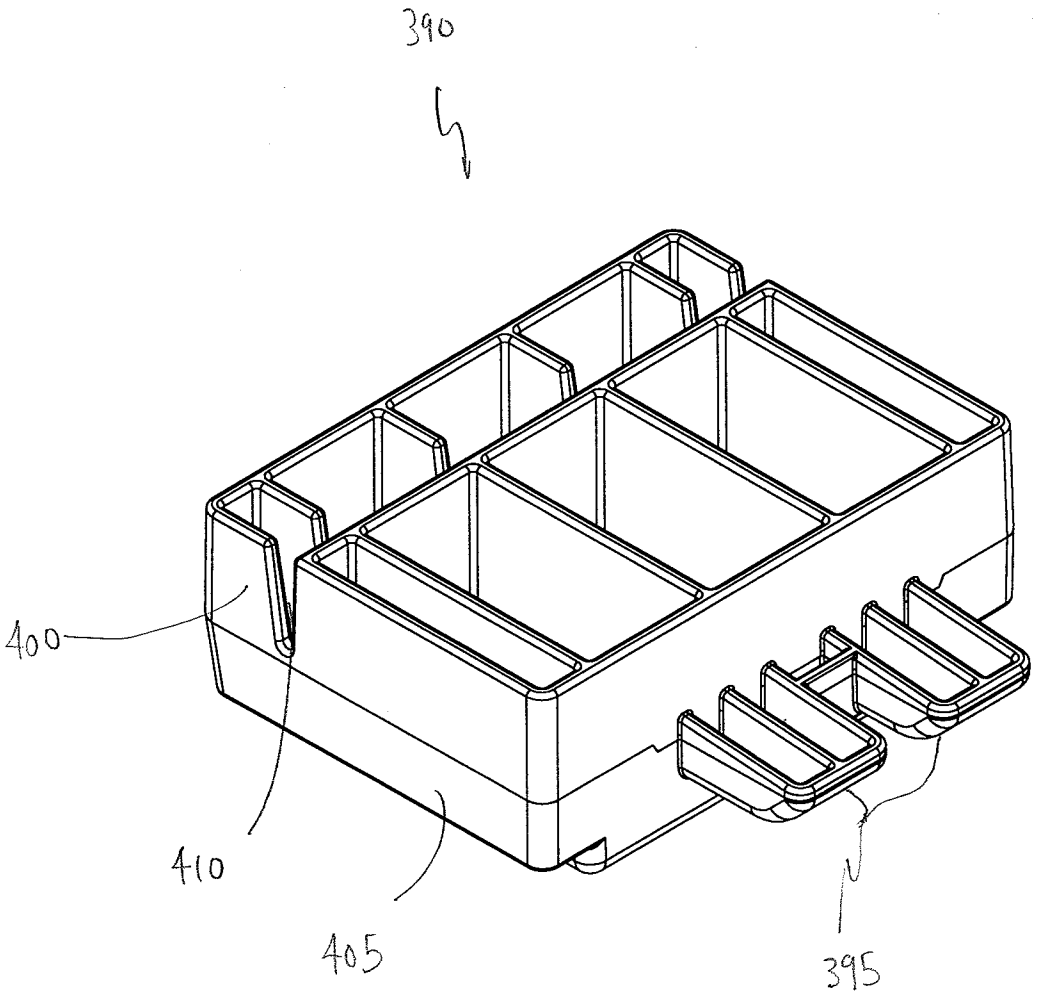
FIG. 16 is a perspective view of a plug-type apparatus useful for more permanently affixing two elements to each other, such as in connection with sidewall and/or drop door applications such as those shown in FIG. 1 (and in place of the latch of FIG. 2 in such applications)

As shown in FIG. 16, the first plug 390 preferably is formed as a unitary structure, although alternative embodiments (not shown) could be assembled from separate pieces. The plug preferably is sufficiently rigid to provide its desired "locking" function, but has sufficient flexibility to be installed and removed from various applications (such as pockets in collapsible container sidewalls and/or drop doors), as described herein. The plug preferably includes at least one catch or finger 395 (similar to the catch 299 of the latch 290) for engaging the container 270. Although the body of the plug can be any suitable shape or configuration, it preferably has a similar size and shape as the preferred latch 290 (so that the plug can be readily interchanged with such latches in various applications). The body 405 of the plug can be described as preferably including a groove 410 (to permit some flexing of the body for aiding in inserting or removing the plug from certain applications). Alternatively, the preferred plug can be described as having a flange portion 400, and a central base 405 joined to the finger 395 and connected to the flange 400 along a groove 410. As noted herein, the groove 410 preferably helps facilitate the first plug 390 to be received by the first pocket, by permitting some flexing of the plug body 405, with material memory of the plug preferably then returning the first plug 390 to its original non-deformed configuration to securely retain it in the pocket of the sidewall or drop door (such as drop door 275) and "fixedly" engage the sidewall 280 (or the other element to which the pocketed element is to be "fixed"). Persons of ordinary skill in the art will understand that the degree of any such "fixed" relationship of parts depends, among other things, on the degree of difficulty in removing the locking plug from such a "locked" relationship. In any case, the preferred plug preferably makes it more difficult to disengage the "locked" elements than does the latch 290.

Figure 17:
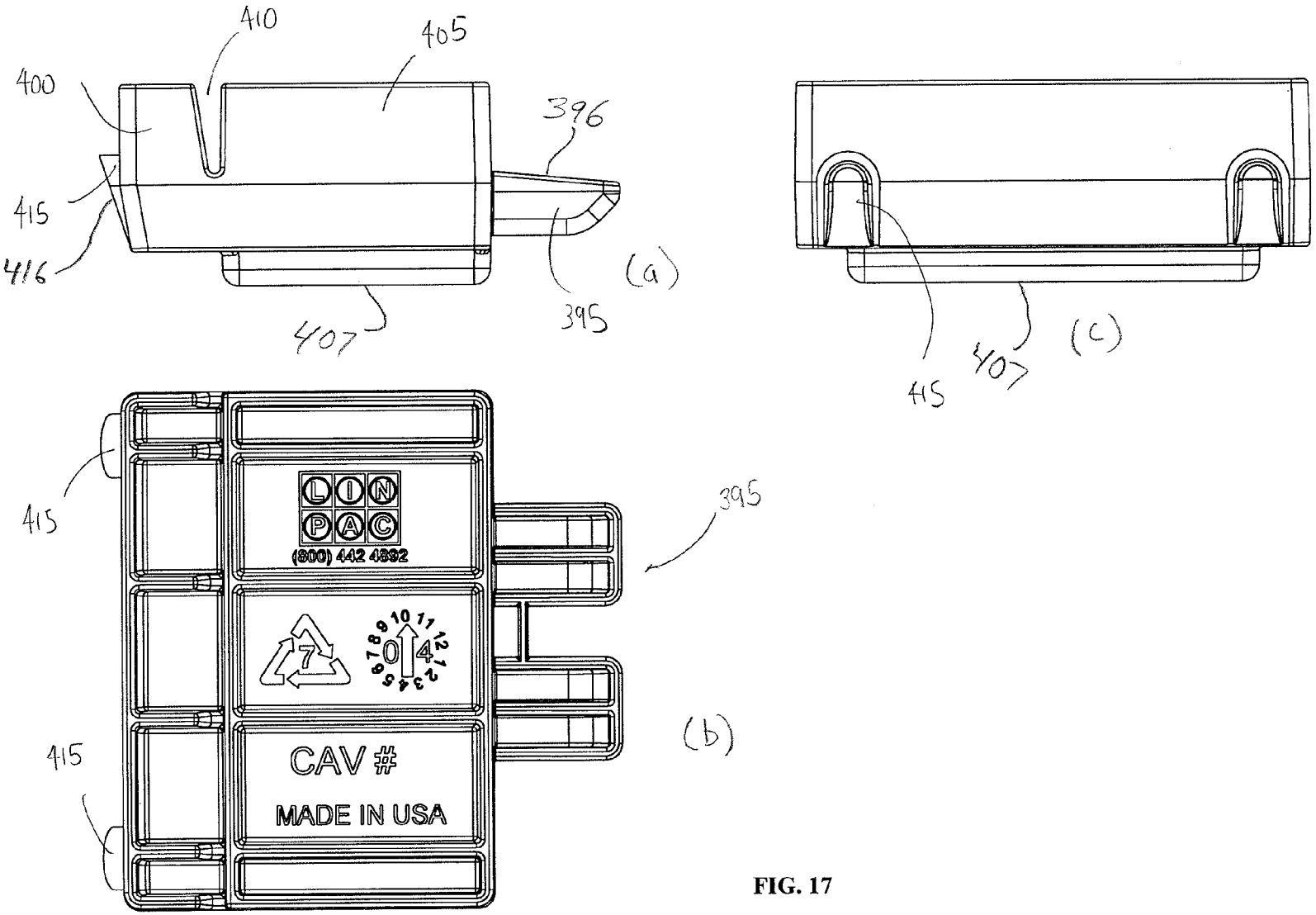
FIG. 17(*a*)-(*c*) shows the plug of FIG. 16 from different views (a—bottom view; b—side view; c—end view)

As shown in FIGS. 17(*a*)-(*b*), similar to the catch or first member 307 of the first latch 290, the finger(s) 395 of the first plug 390 are preferably keyed, or offset from one or both of the horizontal and vertical centerlines of the central base 405, such that for the first plug 390 to be received by the first pocket 295 the first plug 390 requires insertion into the corresponding cavity 335 in a predetermined alignment. Among other things, this keying permits controlled orientation and insertion of the plug in certain applications (such as when the plug is formed with a relatively flat side 407 (see FIGS. 1 and 16) so that surface 407 can form part of a generally flat interior of the sidewall, rather than having a recess such as recesses 345 and 350 on each side of the latch's central body 305). In other applications and embodiments not shown in the drawings, the plug can be formed without a generally flat surface 407, such as with recesses or other shapes or configurations, and can include additional grooves 410 on either side of the plug body 405, a central web between such recesses and/or grooves, or the like. Such alternative embodiments might permit, for example, a single plug configuration to be rotated and or used more universally within certain applications.

Figure 18:
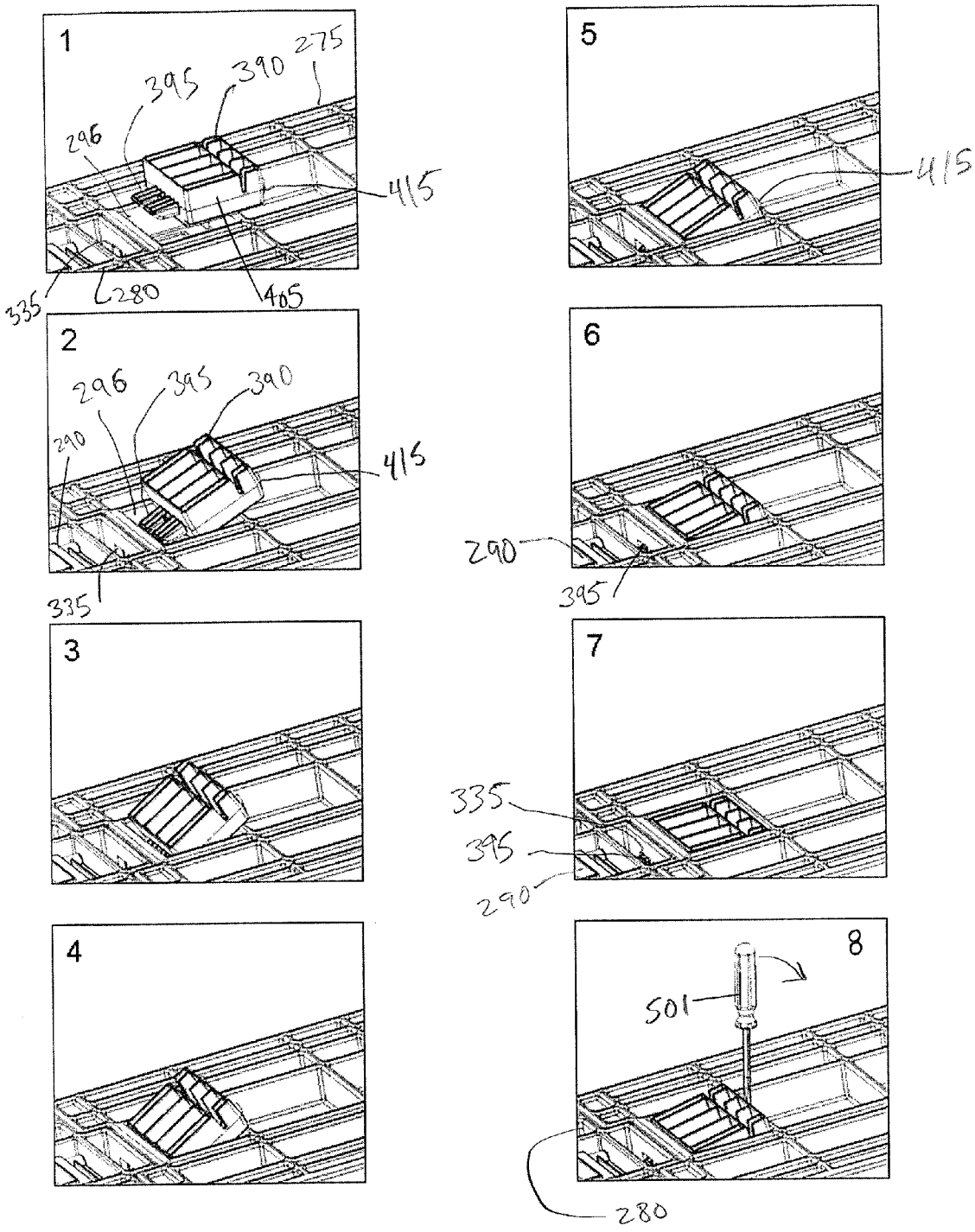
FIGS. 18(1)-(8) are similar to FIGS. 15(1)-(8), but show a preferred method for insertion and/or removal of the plug of FIG. 16 into a pocket such as on a drop door (to "fix" the drop door to the rest of the sidewall)
Figure 19:
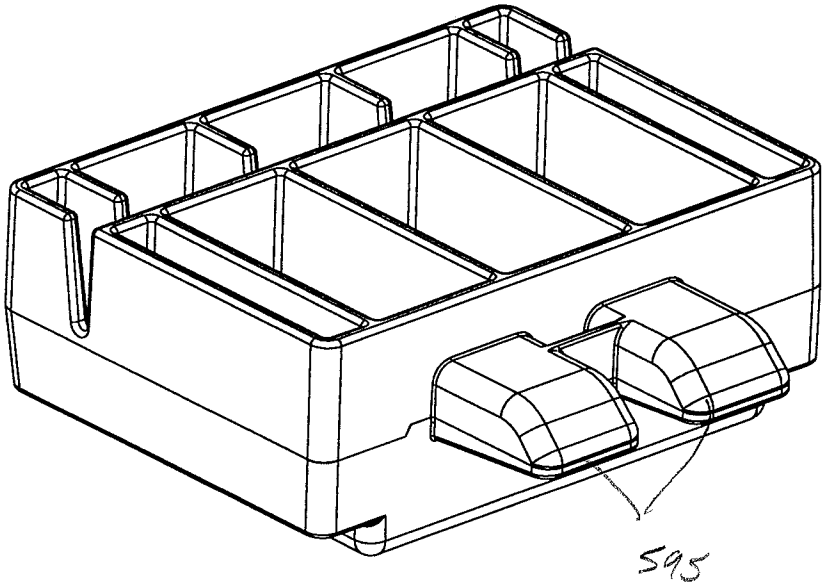
FIG. 19 is similar to FIG. 16, but illustrates one of the many alternative embodiments of a plug member of the invention.

As shown in FIGS. 18(1)-(8), the catch or finger element 395 preferably is received by a corresponding cavity 335 of a pocket such as pocket 296. The plug 390 preferably is aligned with the pocket 296 and removably received by the pocket 296, by pushing the plug's central base 405 into the pocket. The relationship between the plug 390 and pocket 296 causes preferably is snug, to help prevent inadvertent dislodgment of the plug from the pocket. In part because of the preferred snug fit, the groove: 410 preferably is provided to enable the flange 400 to flex toward the central base 405, for easier insertion and removal. In other words, flexing of the flange 400 toward the central base 405 is facilitated by the groove 410 or cutout area between the flange 400 and the central base 405. After the plug 390 is positioned into the pocket 296, the plug's material memory preferably returns the plug 390 to its original non-deformed configuration, which results in a secure interference fit engagement with the sidewall 280.

In the embodiment just described, a single groove 410 is cut along one side the flange 400. Accordingly, flexing of the flange 400 toward the central base 405 occurs on one side of the first plug 390, and the beneficial flexing (to permit desired insertion/removal of the plug into or from a pocket) would not occur, or would not occur as readily, if a user attempted to insert the plug with the groove 410 facing toward the container (for the example illustrated in this portion of the drawings). As a consequence, unlike the substantially uniform construction of the first latch 290 (recesses 345 and 350 on each side of central body 305, and second member 300 positioned substantially along the center of the central base 405 that allows the first latch to be rotated and oriented so that it can be received by and used in any pocket 295-298), the plug 390 as illustrated is preferably not interchangeable between a pocket 295 of the sidewall 280 and an adjacent pocket 296 of the drop door 285. Among other things, rotation of the first plug 390 (such as the rotation illustrated in FIGS. 7-14 for the latch 290) from its position in pocket 296 shown in FIG. 18(7) would inappropriately position the plug 390 for insertion of plug 390 within the adjacent pocket 295, in part because it would not permit the necessary and/or desirable flexing of flange 400.

Accordingly, in one embodiment of the present invention, two different plug designs are configured, one to be selectively used and removably received by pockets such as pocket 295 of the sidewall 280, and another (such as that illustrated in FIGS. 19 and 20) to be selectively used and removably received by the pockets such as pocket 296 of the drop door 285. By comparing FIGS. 16 and 17 to FIGS. 19 and 20, the reader can see that most elements and functions/methods of use of the two embodiments preferably are the same, with the exception being the position and orientation of the respective catches/teeth/fingers 395 and 595. As shown in FIG. 18, the catches 595 are flipped upside down, further to the left and further up than the corresponding catches 395 in FIG. 16. This different orientation preferably allows the plug of FIGS. 19-20 to be readily used in sidewall pocket 295.

Figure 20:
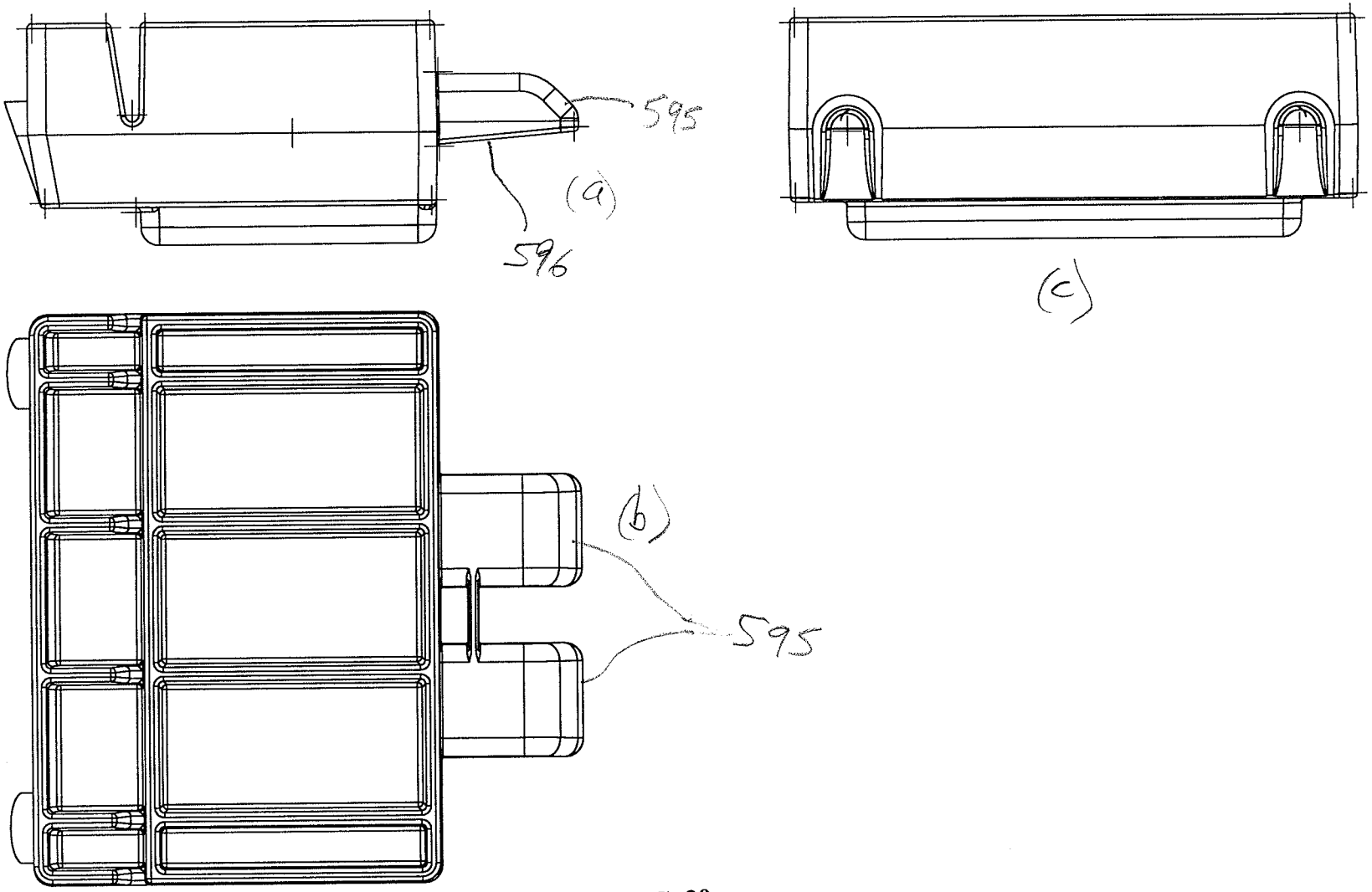
FIG. 20 shows the plug of FIG. 19 from different views (a—bottom view; b—side view; c—end view)

Persons of ordinary skill in the art will understand that the generally flat engaging/locking surfaces 396 of FIGS. 17(*a*) and 596 of FIG. 20(*a*) preferably are positioned to tightly contact the mating end wall surface of the collapsible container, much like the flat surface 286 of the catch 299 of FIG. 4(*a*). However, surfaces 396 of FIGS. 17(*a*) and 596 of FIG. 20(*a*) also preferably have a slight taper (compared to the preferably more flat surface 286 on the latch 290), to further facilitate insertion of the relatively stiff plug into the pocket receptacle on the sidewall, drop door, or other thing.

Persons of ordinary skill in the art will understand that further alternative embodiments of the plug (such as a first plug 390 having a second groove (not shown) on the other side of the first plug 390 or a first plug 390 without a groove) could enable the first plug 390 to be removably received by any of the pockets 295-298.

Figure 21:
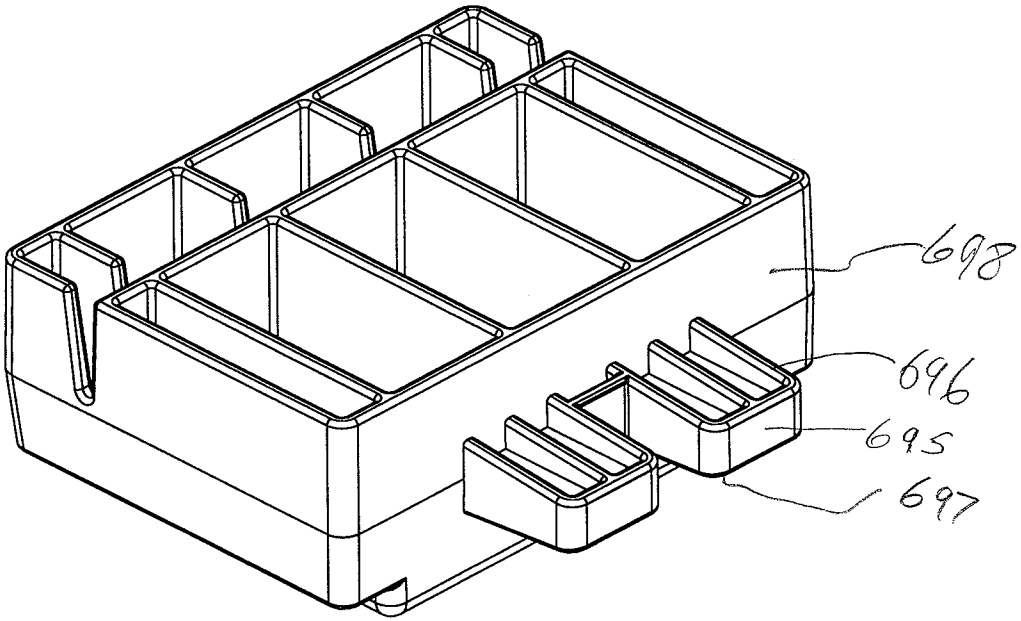
FIG. 21 is similar to FIG. 16, but illustrates still another of the many alternative embodiments of a plug member of the invention.
Figure 22:
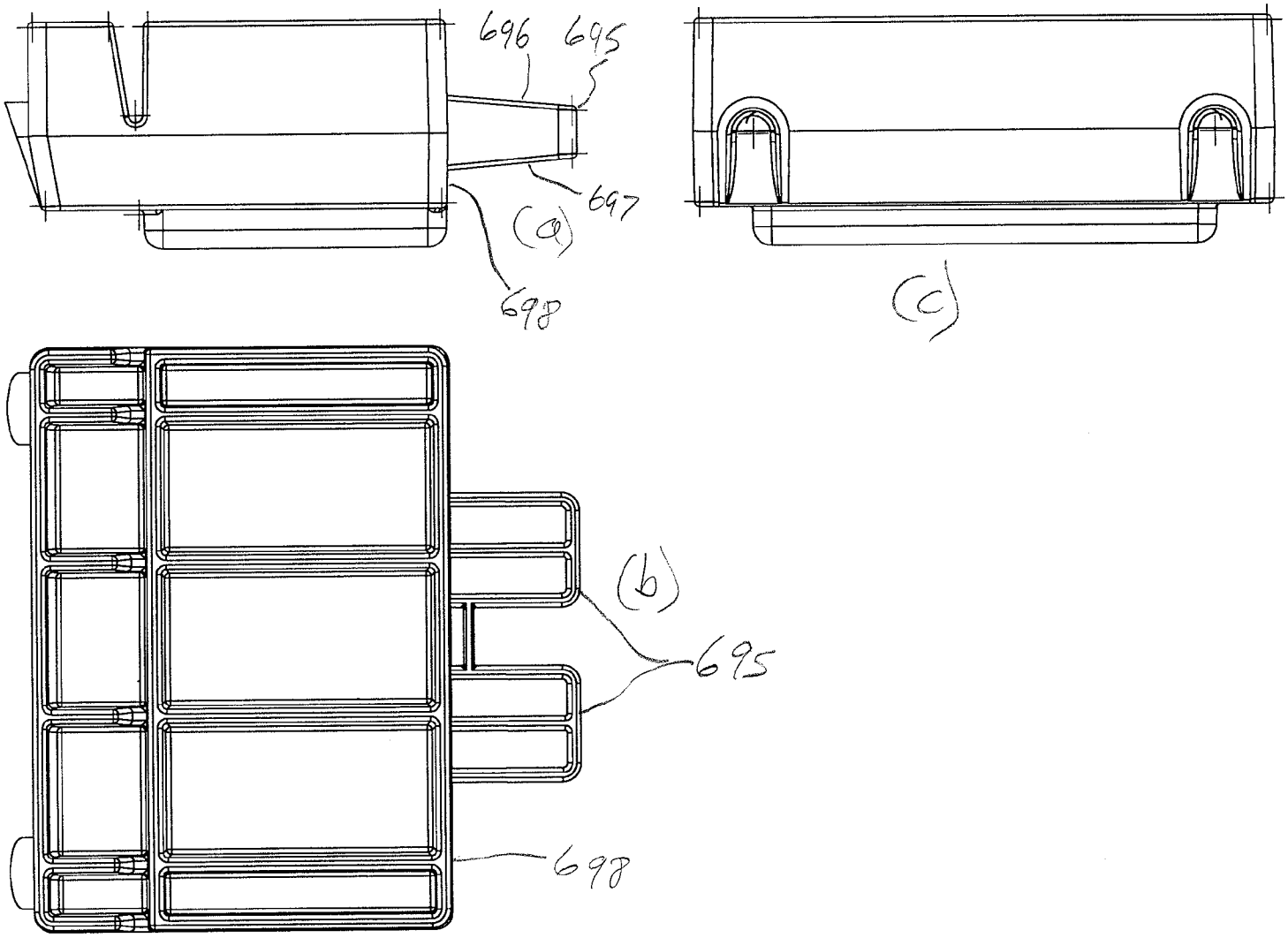
FIG. 22 shows the plug of FIG. 21 from different views (a—bottom view; b—side view; c—end view)

One of the many embodiments of a "direction-neutral" plug is shown in FIGS. 21 and 22, with one or more catch members or teeth/fingers 695 being centered on the face 698 of the plug (rather than being keyed via offsetting them horizontally or vertically on that face), and providing tapered surfaces 696 and 697 in opposing directions (rather than just a single direction) to facilitate insertion/seating/locking of the plug and the items to be locked to each other.

As further shown in FIG. 18(8), plugs such as the first plug 390 preferably are so snugly fit and fabricated from such stiff material that they normally can only be removed from the pocket by using a screw driver 501 or similar device to force flexing of the flange 400 toward the central base 405 thereby permitting the first plug 390 to be removed from the first pocket 295.

As shown in FIGS. 17(*a*) and 17(*c*) and the series in FIG. 18, the plug 390 is preferably retained in the pocket via the interfering fit of one or more detents or extensions 415. These detents or extensions 415 preferably are sized and configured to engage the same holes or receptacles or detents formed in the drop door or sidewall that (as described above) receive distal ends 303 of the latch 290's second member 300. The insertion and removal of the first plug 390 into the first pocket 295 is preferably facilitated by tapering the extensions 415, shown in FIG. 17(*a*) as tapered surface 416.

Alternative embodiments of the first plug 390 including various catch or finger 395 shapes and orientations are shown in FIGS. 19-22, as described above. Among the many additional alternative embodiments (not shown), the plug could be fabricated with no groove 410 (making it less flexible at that location, and therefore possibly requiring thinner webs and flanges or less stiff material or a less snug fit to permit the desired insertion and/or removal), flat surfaces on both sides of the plug, or the like.

In some applications, it may be desirable to have a plug element or elements that can be locked as permanently as possible into the assembly, and that therefore may need little, if any, deformability. Instead, the plug or plugs could simply be forced into its locking position between the two "locked" elements (such as while it was still somewhat hot or had been softened by heating or similar treatment) and left there, with no intention of ever being able to remove it without destroying it or the locked elements or both.

As described above, a preferred embodiment of the invention includes a collapsible container 270 having a base 275 and sidewalls 280(*a*)-(*d*) pivotally attached to the base 275. Any suitable means can be used to hinge the sidewalls 280(*a*)-(*d*) to the container 270. One or more of the sidewalls 280(*a*)-(*d*) may further include a drop door 285 pivotally attached, as also described herein. Additionally, one or more sidewalls 280(*a*)-(*d*) and/or one or more drop doors 285 may include at least one latch to permit engagement and disengagement between a sidewall 280(*a*)-(*d*) and the container 270 and/or a drop door 285 to a sidewall 280(*a*)-(*d*).

The sidewall 280 may include one or more pockets such as a first pocket 295, to removably receive a first latch 290 to engage and disengage the sidewall 280 from the rest of the container, and/or selectively and/or removably receive a first plug 390 (when the first latch 290 is not engaged in the pocket 295) to securely engage the sidewall 280 to the container 270. Many of the components (such as the latches and plugs) preferably are interchangeable with each other, providing great flexibility to manufacturers, customers, and users with respect to production, inventory, and maintenance.

Similarly, the drop door 285 of the illustrated embodiment preferably includes one or more pockets such as a first pocket 291 substantially the same as the first pocket 290 of the sidewall 280. The drop door pocket or pockets preferably also can removably receive a latch 290 to engage and disengage the drop door 285 to the sidewall 280, and further preferably can selectively receive and retain a plug 390 to securely engage the drop door 285 to the sidewall 280. In other words, in the preferred collapsible container embodiment, the latch 290 is interchangeable into any of a plurality of pockets on the drop door and/or sidewall 280, so that a user, distributor, or manufacturer need only provide or stock one type of latch for the container (rather than a custom latch for each such pocket). Even though they are uniform (with respect to each other), that uniform latch design can include "keying" that, when combined with corresponding keying on the things to be latched (such as container sidewalls or drop doors or the like) can help ensure that the uniform latch is properly oriented and positioned in each respective pocket, to provide the desired secure and easy latching relationship between those components. Instead of latches, a plug 390 can alternatively (and preferably selectively) be placed into those pockets or retaining structures to securely and more "permanently" engage those components to each other (such as the sidewall 280 to the container 270 or the drop door within the sidewall.

The present invention also may be considered a conversion system, including a latch member 290 to permit hinged or other relatively moveable engagement and disengagement of a first thing to a second thing and a plug or locking member to hold the first and second thing in a more permanent relationship. Preferably, users can select (or "convert") between the latch and plug to configure and reconfigure the assembly at any time and at virtually any location, into a wide range of selectable and useful states. Such states include, by way of example, a "locked" container that can not be readily collapsed, a collapsible container with effectively solid sidewalls (formed by locking drop doors into position within the sidewalls), and a fully operatively hinged collapsible container with one or more fully operatively hinged drop doors within the sidewall.

In such systems, the first thing preferably has a hinge apparatus 200 to permit rotation between the first thing and the second thing during engagement and disengagement of the first thing to the second thing, a pocket 295 to selectively and removably receive either a latch 290 (to facilitate the ready engagement and disengagement) or a plug 390 (to more permanently or securely engage the first thing to the second thing). The relationship of the first thing relative to the second thing transitions or converts from dynamic (when one or more latches 290 are used in the pocket or pockets) to relatively static (when the plug 390 is placed into the pocket or pockets.

Methods associated with the invention include, without limitation, (1) methods of assembling collapsible containers having latches and/or plugs of the foregoing character; (2) methods of converting the relationship of two or more things from a latched relationship (such as by using one or more latches of the aforementioned character) to a relatively more fixed relationship (such as by using one or more plugs of the aforementioned character); and (3) methods of manufacturing or inventorying or maintaining collapsible containers or similar multi-component assemblies by reducing the number of parts needed to provide or maintain both a (a) hinged item (such as a sidewall having a drop door hinged therein) and a (b) fixed, non-hinged item of similar configuration (such as a sidewall having a drop door "locked" therein to form a virtually solid sidewall that otherwise would have had to have been molded or provided by separate parts instead of locking the drop door into place).

The apparatus and methods of the invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A latch for selectively engaging and disengaging a first container component to a second container component, the latch being operable from a first side and a second opposing side, the latch comprising:

a central body portion having a first central body chamber and a second central body chamber spaced from the first central body chamber, and a first recess positioned on a first side of the central body portion and a second recess positioned on a side opposite the first side, the first recess separated from the second recess by a central web wherein the first recess forms in part a first hand grasp portion to enable a user to linearly compress the latch on a first side of the central body portion and the second recess forms a second hand grasp portion to enable a user to linearly compress the latch on a second side of the central portion;

a first catch element extending outward from a first end of the central body portion;

a plunger element connected to a second end of the central body opposing the first end, the plunger element having a first arm having an interior chamber and an opening at a first end and a closed second end distal from the first end and a second arm having an interior chamber and an opening at a first end and a closed second end distal from the first end, the second arm spaced from the first arm, the first arm connected proximate the second end of the first arm to proximate the second end of the second arm by a bridge, wherein the first arm is in sliding relationship with the first central body chamber of the central body portion and the second arm is in sliding relationship with the second central body chamber of the central body portion; and, a force expansion member acting to force the bridge of the plunger element in a direction away from the catch element extending from the first end of the central body, the force expansion member having a first portion positioned in the interior chamber of the first arm and the first central body chamber of the central body portion, and a second portion positioned in the interior chamber of the second arm and the second central body chamber of the central body portion.

2. The latch of claim 1, wherein the force expansion member being compressible by application of compressive forces on the central body and the plunger element.

3. The latch of claim 2, wherein the first arm is cylindrical and the second arm is cylindrical.

4. The latch system of claim 2, wherein the first thing is a drop door within a collapsible container sidewall and the second thing is a collapsible container sidewall.

5. The latch system of claim 2, wherein the first thing is a sidewall and the second thing is a collapsible container.

6. The latch of claim 3, wherein the central body portion includes at least one catch element that is positioned offset from one of a horizontal centerline and a vertical centerline of the latch.

7. The latch of claim 3, wherein the catch element has an asymmetric shape.

8. The latch system of claim 3, including at least one detent member on the plunger element engaging a corresponding detent track on the central body portion to permit movement of the plunger element toward the central body portion and to limit movement of the plunger element away from the central body portion.

9. The latch of claim 3, wherein the force expansion member includes a first spring positioned in the interior chamber of the first arm and a second spring positioned in the interior chamber of the second arm.

10. The latch of claim 9, wherein the first chamber is cylindrical and the second chamber is cylindrical.

11. The latch system of claim 5, further including a drop door positioned within the sidewall.

12. The latch system of claim 11, wherein the drop door includes:

a first pocket substantially the same as the first pocket of the sidewall to selectively removably receive a latch at least substantially identical to the first latch to selectively engage and disengage the drop door to the sidewall or a first plug to relatively more permanently engage the drop door to the sidewall.

13. The latch system of claim 12, further including a plurality of similarly sized and shaped pockets on said drop door and said sidewall, a plurality of latch assemblies interchangeably usable within any of said pockets.

14. The latch system of claim 13, further including a plurality of plugs interchangeable with the first plug to replace respective latch assemblies and thereby relatively more permanently engage the sidewall, container, and drop door elements.

15. The latch of claim 1, wherein the first arm of the plunger element has a first distal end that extends beyond the bridge and the second arm of the plunger element has a second distal end that extends beyond the bridge.

16. The latch of claim 1, wherein the latch further includes a second catch element spaced from the first catch element.

17. A latch compressible from a first side and a second side comprising:

a first member;

a second member having a first arm with an internal chamber and an opening at a first end and a second end distal from the first end and a second arm with an internal chamber and an opening at a first end and a second end distal from the first end, the first arm spaced from the second arm by a bridge connected proximate the second end of the first arm and proximate the second end of the second arm; and a central body joined to the first member so that the first member extends outward from a first end of the central body in a first direction, and movably connected at a second end opposite the first end to the second member by a third member, the central body including a first central body chamber for receiving the first arm of the second member and a second central body chamber for receiving the second arm of the second member, and a first recess positioned on a first side of the central body portion and a second recess positioned on a side opposite the first side, the first recess separated from the second recess by a central web wherein the first recess forms in part a hand grasp portion to enable a user to linearly compress the latch on a first side of the central body portion and the second recess forms a hand grasp portion to enable a user to linearly compress the latch on a second side of the central portion, wherein the third member is positioned within the first and second central body chambers of the central body and the interior chamber of the first arm and the interior chamber of the second arm to force the second member in a direction opposite from the first direction and into engagement with a first container component, to enable engagement of the first member with a second container component, wherein movement of the central body toward the second member compresses the third member to permit engagement and disengagement of the first container component from the second container component.

18. The latch of claim 17, wherein the second member includes a bridge between the first arm and the second arm.

19. The latch of claim 17, wherein the first chamber is cylindrical and the second chamber is cylindrical.

20. The latch of claim 17, wherein said latch includes a catch element keyed to be received in a pocket only in a predetermined alignment.

21. The latch of claim 20, wherein said keying is accomplished by offsetting the catch element from one of the horizontal and vertical centerlines of the latch member.

22. The latch of claim 17, wherein the latch is spring-loaded to permit it to be relatively completely collapsed for insertion into a pocket and further including means to prevent said relatively complete collapse during actuation of the latch to disengage a first and second container component from each other.

23. The latch of claim 19, wherein the first container component is a drop door and the second container component is a side wall.

24. The latch of claim 18, wherein the second member includes a detent member to engage a corresponding detent track on the central body.

25. The latch conversion system of claim 18, wherein the first thing includes access ports to permit manipulation of the latch member from opposite sides of the first thing when the first latch is positioned in the pocket.

26. The latch conversion system of claim 25, wherein the latch member includes a first recess on one side and a second recess on an opposite side to facilitate manipulation of the latch member to disengage the first and second thing from each other.

27. A container assembly, including at least one sidewall, at least one drop door positioned within a corresponding opening in said sidewall, at least one set of interfering strictures acting between the drop door and the sidewall to engage each other when inward and or outward forces are applied on one or both of the sidewall and drop door, and at least one locking plug holding the sidewall and the drop door and the set of interfering structures in operative alignment.

28. The container assembly of claim 27, in which the interfering structures generally form a tongue-and-groove cross-section.

29. The container assembly of claim 27, including at least one hinge member mountable between the sidewall and the drop door, and at least one latch member mountable in place of the at least one locking plug to permit the drop door to move in a hinged relationship with respect to the sidewall.

30. The latch mechanism of claim 27 in combination with a collapsible container sidewall having a drop door access panel, in which the plurality of locations include receiving areas on both the sidewall and the drop door access panel, and the receiving areas are keyed to correspond to the keyed latch mechanism to require a desired orientation of the latch mechanism in order to assemble it into any receiving area.

31. A collapsible container assembly, comprising: a sidewall having at least one connector-receiving area; a drop door positioned within said sidewall and having at least one connector-receiving area; a plurality of uniform latch members usable in any such connector-receiving area.

32. The collapsible container assembly of claim 31, in which said latch members include catch portions keyed correspondingly to said connector-receiving areas, said keying ensuring that said latch members can only be assembled with said connector-receiving areas in an operable orientation.

33. The collapsible container assembly of claim 31, in which said latch members are readily removable from engagement with said connector-receiving areas.

34. The collapsible container assembly of claim 31, further including a plurality of uniform plug members usable in at least said drop door connector-receiving area to relatively more permanently engage the drop door to the sidewall.

35. The system of claim 31, in which said second thing is adjacent to a third thing, and said plurality of latches are engageable with corresponding secondary latch-receiving structures on said second thing, said plurality of latches and said corresponding secondary latch-receiving structures configured and positioned to selectably hold said second thing in a desired engagement with said third thing.

36. The system of claim 35, in which said first thing is a drop door, said second thing is a sidewall, and said third thing is an adjacent sidewall.

37. The system of claim 31, including a plurality of locking members interchangeably mountable in said plurality of corresponding latch-receiving structures on said first thing, said locking members and latch-receiving structures configured and positioned to relatively permanently hold said first thing in a desired engagement with said second thing.

38. An engagement system, including a plurality of locking members interchangeably mountable in a plurality of corresponding locking member-receiving structures on a first thing, said first thing being adjacent to a second thing and said locking members and locking member-receiving structures configured and positioned to relatively permanently hold said first thing in a desired engagement with said second thing.

39. The system of claim 38, in which said second thing is adjacent to a third thing, and said plurality of locking members are engageable with secondary locking member-receiving structures on said second thing, said locking members and said secondary locking member-receiving structures configured and positioned to relatively permanently hold said second thing in a desired engagement with said third thing.

40. The system of claim 38, in which said first thing is a drop door, said second thing is a sidewall, and said third thing is an adjacent sidewall.

41. The system of claim 38, including a plurality of latch members interchangeably mountable in said plurality of corresponding locking member-receiving structures on said first thing, said latch members and locking member-receiving structures configured and positioned to selectably hold said first thing in a desired engagement with said second thing.

42. The system of claim 38, in which the locking members and the locking member-receiving structures are keyed to require that they be assembled in a desired orientation relative to each other.

43. A convertible container sidewall, including a first part and a second part, at least one pocket formed on said first part to interchangeably receive a latch or a locking member, said first part, said second part, said pocket, said latch, and said locking member being configured and positioned so that (a) selection and use of the latch selectably holds the first part in a desired relationship with said second part, and (b) selection and use of the locking member relatively permanently holds the first part in a desired relationship with said second part.

* * * * *